US012799681B2

(12) United States Patent
Micallef et al.

(10) Patent No.: US 12,799,681 B2
(45) Date of Patent: Nov. 17, 2026

(54) RAIL SUPPORT ARRANGEMENT

(71) Applicant: The Council of the City of Coventry, Coventry (GB)

(72) Inventors: Christopher Micallef, Coventry (GB); Florent Menage, Sancergues (FR)

(73) Assignee: THE COUNCIL OF THE CITY OF COVENTRY COUNCIL HOUSE, West Midlands (GB)

( * ) Notice: Subject to any disclaimer, the term of this patent is extended or adjusted under 35 U.S.C. 154(b) by 660 days.

(21) Appl. No.: 18/261,452

(22) PCT Filed: Jan. 12, 2022

(86) PCT No.: PCT/GB2022/050061
§ 371 (c)(1),
(2) Date: Jul. 13, 2023

(87) PCT Pub. No.: WO2022/153046
PCT Pub. Date: Jul. 21, 2022

(65) Prior Publication Data

US 2024/0084514 A1 Mar. 14, 2024

(30) Foreign Application Priority Data

Jan. 12, 2021 (GB) ..... 2100380
Jun. 28, 2021 (GB) ..... 2109273

(51) Int. Cl.
*E01B 1/00* (2006.01)
*E01B 3/40* (2006.01)

(52) U.S. Cl.
CPC ..... *E01B 1/004* (2013.01); *E01B 1/002* (2013.01); *E01B 3/40* (2013.01)

(58) Field of Classification Search
CPC ..... E01B 1/002; E01B 1/004; E01B 29/00; E01B 3/40
See application file for complete search history.

(56) References Cited

U.S. PATENT DOCUMENTS 3,587,964 A * 6/1971 Cork ..... E01B 2/003 404/31
4,905,896 A 3/1990 Eisenmann
(Continued)

FOREIGN PATENT DOCUMENTS

DE 102011015210 A1 * 9/2012 ..... E01B 1/00
EP 0327247 A2 * 8/1989 ..... E01B 9/28
EP 1700954 A2 * 9/2006 ..... E01B 9/66
EP 2287400 A2 2/2011
(Continued)

OTHER PUBLICATIONS

B.S. Al-Azzawi et al., Flexural Fatigue Behavior of a Self-Compacting [UH PFC], Journal of Materials in Civil Engineering, vol. 29, Iss. 11, Abstract accessed on Jan. 1, 2026 available at: https://ascelibrary.org/doi/10.1061/%28ASCE%29MT.1943-5533.0002051 (Year:2017).

(Continued)

*Primary Examiner* — Jason C Smith
(74) *Attorney, Agent, or Firm* — Kilpatrick Townsend & Stockton LLP

(57) ABSTRACT

A rail support arrangement (100, 100*a*, 100*b*, 100*c*, 100*d*, 800, 1000, 1100) to which rails (190) and/or other track elements may be coupled. A plurality of rail supports (130) are embedded in grooves (120,1121A,1121B,1122A,1122B) in a slab (110,1010). Each rail support is configured to receive a rail fastening system (160) and comprises a projection (135) that engages with the rail fastening system in order to secure a rail or other track element to the rail support.

21 Claims, 7 Drawing Sheets

(56) References Cited

U.S. PATENT DOCUMENTS

| | | | | |
|---|---|---|---|---|
| 7,896,255 | B2 * | 3/2011 | Frenzel | E01B 1/008 238/2 |
| 8,893,982 | B2 * | 11/2014 | Van Der Houwen | E01B 3/44 238/281 |
| 2004/0221532 | A1 * | 11/2004 | Shillington | E01C 9/04 52/459 |
| 2013/0206853 | A1 * | 8/2013 | Robinson | E01B 1/001 238/2 |
| 2014/0042235 | A1 * | 2/2014 | Van Der Houwen | B28B 19/0046 238/84 |
| 2018/0023258 | A1 * | 1/2018 | Tusino | E01B 1/002 238/174 |
| 2024/0084514 | A1 * | 3/2024 | Micallef | E01B 1/002 |
| 2024/0084515 | A1 * | 3/2024 | Micallef | E01B 29/00 |

FOREIGN PATENT DOCUMENTS

| | | | | |
|---|---|---|---|---|
| FR | 2845700 | A1 * | 4/2004 | E01B 3/40 |
| FR | 2865225 | A1 * | 7/2005 | E01B 7/22 |
| FR | 2942482 | A1 * | 8/2010 | E01B 9/28 |
| JP | 2018091063 | | 6/2018 | |
| JP | 2018091063 | A * | 6/2018 | |
| RU | 2151832 | C1 * | 6/2000 | E01B 2/006 |
| WO | WO-2026021627 | A1 * | 1/2026 | |

OTHER PUBLICATIONS

PCT/GB2022/050061, International Search Report and Written Opinion, Mailed on Mar. 23, 2022, 15 pages.

PCT/GB2022/050064, International Search Report and Written Opinion, Mailed on Apr. 4, 2022, 15 pages.

* cited by examiner

RAIL SUPPORT ARRANGEMENT

FIELD OF THE INVENTION

The present invention relates to the field of railway infrastructure, and in particular, to railway infrastructure for a light rail system.

BACKGROUND OF THE INVENTION

There is a long tradition of railway infrastructure that provides rails along which a rail-based vehicle, such as a tram or train, can be propelled.

In traditional railway infrastructure, rails are mounted upon railway sleepers or ties, which lie perpendicular to the direction of the track. Each railway sleeper provides two fixed locations to which the rail can be secured. The railways sleepers themselves are usually lain upon track ballast, typically formed of crushed stone (e.g. gravel), so that a load carried by the railways sleepers (e.g. of the tram/train) is distributed into the track ballast.

Another type of railway infrastructure is known as a "ballastless" or "slab-track", in which multiple railways sleepers are mounted on, or integrated in, a single (concrete) slab. Thus, a slab is able to couple to each rail at two or more different locations. This approach avoids the need for ballast, and provides advantages of improved performance capacity, reduction in maintenance cost/complexity and improve lifespan.

Conventional slabs for railway infrastructure (sometimes called "precast slabs") have fixed positions to which the rails can be secured. Usually, these fixed positions are arranged to simulate a linear arrangement of railway sleepers, e.g. comprise two, parallel groups of linearly arranged fixed positions.

Existing slabs are usually formed from reinforced or pre-stressed concrete, and generally have a minimum thickness of around 17 cm. Moreover, a slab is typically around 5 m long and 2.20 m wide resulting in a high weight of around 5 tons. This makes it necessary to utilize heavy-load handling systems making the handling and transportation of these slabs relatively expensive.

There is an ongoing desire to improve slabs for railway infrastructure, and in particular, to make slabs more suitable for use in an urban environment.

SUMMARY OF THE INVENTION

The invention is defined by the claims.

The present disclosure describes concepts that can offer a thin slab design for a rail support system/arrangement that makes use of appropriate high strength materials together with an integral and highly flexible rail supporting system. The rail supporting system further allows installation of other track systems including anti-bouncing devices, turnouts/switches and so on. The proposed approach allows for flexibility in the positioning of rails upon a slab-based rail support arrangement, allowing the same slabs to be used for different rail angles and the like.

In particular, there is an aim to provide a slab-based rail system formed of rail support arrangements that have an ability to accommodate tight curves or bends and that can, e.g. if installed within existing highways, be (re)installed without significant disruption to existing buried infrastructure (e.g. utilities or services). It would also be advantageous if the rail support arrangement had a low mass.

According to examples in accordance with an aspect of the invention, there is provided a rail support arrangement for supporting one or more rails, the rail support arrangement comprising: a slab having two or more primary transverse grooves; and a plurality of rail supports, each rail support being mounted in a respective primary transverse groove and comprising at least one projection configured to engage with a rail fastening system, received in the respective primary transverse groove, that couples a rail to the rail support so as to restrict or prevent a movement of the rail in a direction perpendicular to the direction of the respective primary transverse groove.

A slab, sometimes called a "track slab" or "precast slab", is a well-known term in the rail industry to refer to a panel or sheet of material that can act to distribute load and provide track stability. The slab is generally shaped to have a length and width much greater than its height/depth, and may be formed in a cuboidal shape, a trapezoidal prism shape and so on.

The present disclosure provides a slab track having a series of transverse grooves that enable the insertion and securing (via respective rail supports) of rail fastening systems at different locations along the transverse groove. This provides a mechanism by which rails can be positioned in a wide variety of alignments with respect to the slab, thereby accommodating rails undergoing sharp turns or corners.

In particular, the present invention proposes the use of a plurality of rail supports, so that the rail can be secured to the slab at a wide variety of orientations, positions and/or angles. Thus, there is a high level of flexibility in choosing the position and orientation at which the rail is secured to the slab. This means that a same slab structure can be used for a wide variety of track configurations (e.g. straight line sections, curved sections and so on). Use of a same slab structure reduces manufacturing cost and complexity.

The ability of the proposed rail support system to accommodate sharp turns or corners is particularly advantageous for an urban environment, in which railway infrastructure needs to be positioned around existing infrastructure (e.g. buildings, existing roads or pavements/sidewalks). The proposed slab thereby facilitates more economic and flexible placement of railway infrastructure in an urban environment.

The (at least one) projection may be generally parallel to an uppermost surface of the slab, e.g. in a same plane as the surface of the slab. In particular, the projection(s) may be in a horizontal plane. In other examples, the projection may have a slight downward angle/incline, i.e. away from the upper(most) surface(s) of the slab. The projection may be (generally) planar, to provide a surface against which the rail fastening system is configured to engage (e.g. using a clamp, bolt or other fastening system).

In some examples, the projection extends outwardly from a side wall of the respective primary transverse groove, and may extend in a direction generally perpendicular to a sidewall of the primary transverse groove or angled with respect to the side wall. For instance, the protection may extend in a direction angled towards the floor of the primary transverse groove.

Generally, a slab is considered to have three dimensions: a length, a width and a height/depth. The length is the longest dimension of the slab, the width the second longest and the depth the shortest. A transverse groove is an elongate groove, channel or trench having a direction across the width of the slab (e.g. parallel to the shortest side of the upper surface of a non-grooved slab). The width of a slab is defined as a side to side distance, and is generally angular to a direction of the rail coupled to the rail support. Thus, a transverse groove is aligned in a transverse, lateral or side-to-side direction of the slab.

The "direction" of a primary transverse groove is a direction in which the primary transverse groove extends, i.e. in a lateral direction of the slab. The direction perpendicular to the direction of a primary transverse groove may be a vertical direction (e.g. in a direction perpendicular/normal to an uppermost surface of the slab).

Each primary transverse groove is located at different positions along a length of the slab. That is, the primary transverse grooves may be offset from one another.

In some examples, each primary transverse groove spans no more than 40% of the entire width of the slab, and preferably no more than 30% of the entire width of the slab.

The two or more primary transverse grooves comprises two or more sets of primary transverse grooves, wherein each primary transverse groove in a same set are positioned along a same hypothetical transverse line. In some examples, each set comprises only two primary transverse grooves. Such embodiments facilitate flexible angling/positioning of a pair of rails to the rail support.

Preferably, each primary transverse groove in a same set extends from or to a respective side edge of the upper surface of the slab. This embodiment provides an additional path for water to exit or drain from an upper surface of the slab and/or from the grooves themselves (reducing a likelihood of water damage or rust to anything located in/near the grooves, such as the rail support or a rail secured to the rail support. This embodiment also provides a space in the center of the slab for positioning additional elements (such as through-holes for installing the rail support arrangement and/or water exiting.

In some examples, for each set of primary transverse grooves, the combined length of the primary transverse grooves in that set is no more than 60% of the entire width of the slab. This embodiment provides sufficient flexibility for positioning of rails on the rail support arrangement whilst reducing an amount of material.

In some examples, each primary transverse groove spans no less than 10% of the entire width of the slab.

Optionally, the two or more primary transverse grooves comprises at least two primary transverse grooves of different lengths.

In some examples, the slab further comprises, for each of one or more primary transverse grooves, a supporting transverse groove into which the primary transverse groove is inset. The at least one supporting transverse groove may comprise a rail paid area configured to support a rail pad upon which a rail is supportable. The rail support arrangement may further comprise, for at least one rail pad area, a rail pad configured to support a rail thereon. The rail pad(s) help(s) to cushion the rail's impact on the slab. In particular, the rail paid helps to spread the load transfer from the rail to the slab, and reduce point stress concentrations. It also provides a vibration absorbing layer.

Each primary transverse groove may span no less than 10% of the entire width of the slab. Thus, each primary transverse groove may be a transverse groove that spans no less than 10% of the entire width of the slab. In some examples, each primary transverse grooves spans between 10% and 30% of the entire width of the slab. This embodiment provides sufficient flexibility for angling and/or positioning the rail(s) whilst reducing an amount of material needed for a rail support and to facilitate the positioning of other component parts of the rail support arrangement in the slab.

Each primary transverse groove may span no less than 20% of the entire width of the slab. Thus, each primary transverse groove may be a transverse groove that spans no less than 20% of the entire width of the slab. It has been identified that the greater the width of the primary transverse groove, the greater the flexibility in angling or positioning the rail(s) when mounting them to the slab.

In some examples, each primary transverse groove spans no less than 60% of the entire width of the slab. In some examples, each primary transverse groove spans no less than 75% of the entire width of the slab.

In some examples, each primary transverse groove may span the entire width of the slab. This facilitates ease of inserting any rail fastening system into the transverse groove, by allowing the rail fastening system to be inserted at a side of the transverse groove (e.g. to avoid the projection (s)).

It is also recognized that a larger primary transverse groove will increase the cost of the slab (as the material for the rail support(s) is usually more expensive than the material for the slab). Thus, in some examples, the primary transverse groove may span no more than 90% of the entire width of the slab, e.g. no more than 80% of the entire width of the slab.

In some examples, the projection of each rail support spans no less than 90% of the respective primary transverse groove in which the respective rail support is mounted. This approach provides an extremely large number of possible positions for securing the rail to the rail support, by provide a large, continuous structure against which the rail can be secured (via the rail fastening system). Preferably, each projection of each rail support spans no less than 90% of the respective primary transverse groove in which the respective rail support is mounted.

The (or each) rail support may comprise a first projection and a second projection, each configured to simultaneously engage with the rail fastening system to thereby couple the rail to the rail support. The first and second projections may extend from opposing walls or sides of the primary transverse groove into which the rail support is positioned.

In this way, the first and second projections may effectively act as a C-rail like structure, in which the rail fastening system is able to clamp on both first and second projections to securely couple the rail to the rail support, and thereby to the slab.

The first and the second projections may lie in a same (horizontal) plane, e.g. face or oppose one another in the primary transverse groove, e.g. to allow a rail fastening system to grip the rail support at two opposing surfaces.

The slab may be formed from fiber reinforced concrete.

Fiber reinforced concrete improves the elastic and fatigue resistance of the slab, compared to conventional concrete (used as standard in conventional slabs for rail systems). Use of fiber reinforced concrete thereby allows for a thinner slab to be used, to reduce the difficulty in installing and/or removing the slab, as well as reducing the excavation depth required to install railway infrastructure utilizing the rail support arrangement, e.g. to allow underground utilities and services (e.g. water, gas, electricity, communication fibers etc.) to remain unaffected by the railway infrastructure.

Preferably, the slab is formed from ultra-high performance fiber reinforced concrete (UHPFRC). The present disclosure proposes the use of UHPFRC in a slab-based rail support system to facilitate thin-slab railway infrastructure.

The inventors have innovatively recognized that UHPFRC can be adapted for use in the rail industry to provide extremely thin and light slabs that still have the performance criteria required for supporting and/or mounting elements of railway infrastructure, e.g. rails, turnouts, and the like.

UHPFRC has a standardized ruleset, e.g. as set out in the French standard NF P 18-710, "National Addition to Eurocode 2—Design of Concrete Structures: Specific Rules for Ultra-High Performance Fiber-Reinforced Concrete (UHPFRC)". The skilled person would therefore readily understand the meaning and scope of the term UHPFRC.

In some embodiments, the slab has a length no greater than 12 m, and preferably no greater than 8 m, and even more preferably no greater than 4 m.

Each rail support may comprise a plurality of elongate anchors, each configured to protrude into the slab, to thereby secure the rail support to the slab. The elongate anchors provide a mechanism by which the rail support can be embedded into the material of the slab. Other approaches for securing the rail support to the slab could be used, e.g. adhesive or through the use of interlocking and complementary geometric shapes (in which complementary shapes of the rail support and the slab interlock with one another).

The height of the slab may be no greater than 15 cm, and preferably no greater than 11 cm.

The slab may further comprise one or more secondary transverse grooves in which no rail supports are mounted. The secondary transverse grooves provide a gap for performing cutting/welding of a rail coupled to the rail supports, e.g. for the purpose of maintenance and/or upgrade. In particular, the secondary transverse grooves allow for welding to be performed around the entire circumference of the rail, to improve the welding efficiency.

The use of the secondary transverse grooves means that a part/portion of the tracks and slab (beneath the tracks) could be cut out, e.g. to access an area beneath the slab (e.g. for accessing utilities), and can be subsequently replaced. By providing the secondary transverse grooves, the rails can be rewelded together, thereby avoiding a need to remove large chunks of slab and rail.

The secondary transverse grooves also allows two different rails to be mounted on a same slab and welded together, improving the flexibility of placing rails upon a line of slabs (e.g. positioned adjacent to one another).

The secondary transverse grooves also facilitate maintenance of the rail, which typically (but not essentially) includes rail re-welding and/or replacement.

The depth of each secondary transverse groove may be greater than the depth of each primary transverse groove and/or the width of each secondary transverse groove may be greater than the width of each primary transverse groove. The precise dimensions of the secondary transverse grooves may be selected or set in order to provide sufficient space for the welding process.

Preferably, the distance between each secondary transverse groove is no less than 0.75 m. For instance, the distance between each secondary transverse groove may be no less than 1 m or around 1 m exactly. Preferably, the distance between each secondary transverse groove is no more than 2 m, to provide sufficient space for maintaining rails connected to the rail supports.

There is also proposed a rail support system comprising a first rail support arrangement as herein described; a second rail support arrangement as herein described; and a stiffening bar adapted to couple a rail support of the first rail support arrangement to a rail support of the second rail support arrangement. The stiffening bar acts as an anti-bouncing device, to effectively secure the slabs of the first and second rail support arrangement together so that vertical movement in one slab (e.g. caused by the load of the train) induces a vertical movement in the other slab. This effectively provides a "continuous slab" configuration for reducing vertical bouncing of a vehicle being propelled over the rail(s).

It will be apparent that the rails themselves also partially act as anti-bouncing devices. The stiffening bar should be distinguished from the rail in that they are not configured to mount or support the transportation of a rail-based vehicle, rather, they are configured only for coupling rail support arrangements together.

The stiffening bar is preferably configured to distribute a shear stress between the first and second rail support arrangements.

There is also proposed a rail securing system comprising: the rail support arrangement herein described or the rail support system herein described; one or more rail fastening systems, each rail fastening system being configured to: engage with an upper surface of a rail support of the rail support arrangement or rail support system; and couple a rail to the rail support, so as to restrict or prevent a movement of the rail in a direction perpendicular to the direction of the respective primary transverse groove. The direction perpendicular to the direction of the respective primary transverse groove may be a vertical direction.

There is also proposed a rail system comprising: the rail securing system previously described; and one or more rails, each rail being coupled by the one or more rail fastening systems to one or more rail supports.

These and other aspects of the invention will be apparent from and elucidated with reference to the embodiment(s) described hereinafter.

BRIEF DESCRIPTION OF THE DRAWINGS

For a better understanding of the invention, and to show more clearly how it may be carried into effect, reference will now be made, by way of example only, to the accompanying drawings, in which.

DETAILED DESCRIPTION OF THE EMBODIMENTS

Figure 1:
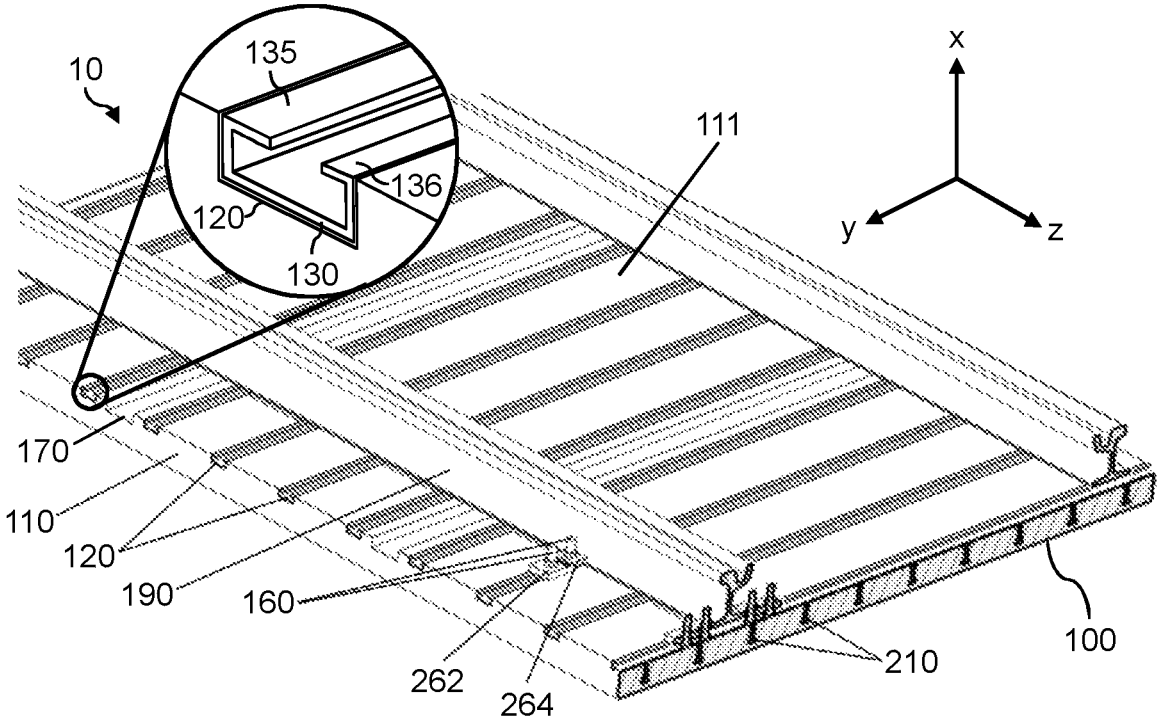
FIG. 1 provides a perspective view of a rail support arrangement.

The invention will be described with reference to the Figures.

It should be understood that the detailed description and specific examples, while indicating exemplary embodiments of the apparatus, systems and methods, are intended for purposes of illustration only and are not intended to limit the scope of the invention. These and other features, aspects, and advantages of the apparatus, systems and methods of the present invention will become better understood from the following description, appended claims, and accompanying drawings. It should be understood that the Figures are merely schematic and are not drawn to scale. It should also be understood that the same reference numerals are used throughout the Figures to indicate the same or similar parts.

The invention provides a rail support arrangement to which rails and/or other track elements may be coupled. A plurality of rail supports are embedded in grooves in a slab. Each rail support is configured to receive a rail fastening system and comprises a projection that engages with the rail fastening system in order to secure a rail or other track element to the rail support.

The inventors have recognized that such rail supports may be used to secure a rail to a slab track at a variety of positions and orientations, and that this allows a same slab to be used for different track configurations, e.g. for straight sections of track, for curved sections of track, for turn-outs and so on.

In the context of the present invention, a "vertical" direction is considered to be a direction which is normal/perpendicular to an upper surface of a slab when the slab is placed flat (i.e. on level ground). A "horizontal" direction is a direction that lines in a plane parallel to a plane in which an upper surface of the slab lies when the slab is placed flat (i.e. on level ground).

FIG. 1 illustrates a rail system 10, comprising a rail support arrangement 100 according to an embodiment of the invention. The rail support arrangement 100 is configured for supporting one or more rails 190 and/or other pieces/elements of rail infrastructure (e.g. points, switches, turnouts and so on). The rail 190 may be any suitable rail, such as according to the EN14811 standard.

The rail support arrangement 100 is formed of a slab 110. Suitable materials for the slab will be described later.

The term "slab" has a well-established meaning in the railway infrastructure field to refer to a generally rigid piece of material upon which rails are mounted. In particular, a slab is generally able to couple to a single rail at two or more different locations (e.g. compared to a sleeper, which connects to a single rail at a single location only). Thus, when supporting two rails, a slab is able to be coupled to each rail at two or more different locations (for each rail).

A slab is shaped to have a length (generally in the direction z of rails positioned on the slab), a width (generally in a direction y perpendicular to the direction z) and a height/depth, which is lies in the vertical direction x. The illustrated slab is generally cuboidal, although other possible 3D shapes are plausible, such as trapezoidal prisms, chevron prisms and so on.

The upper(most) surfaces 111 of the slab 110 are (preferably) substantially planar and lie within a same plane. This facilitates ease of placement of a rail 190 and/or other pieces of rail infrastructure upon the slab. In some examples, an elastomeric pad may be mounted or position on the upper (most) surfaces 111 of the slab 110, e.g. to provide a buffer between the rail 190 and the slab 110.

The slab 110 according to the present disclosure has a plurality of primary transverse grooves 120, which are grooves, channels or cuts in the slab 110. The primary transverse grooves 120 are aligned to lie along a width (i.e. be positioned in a transverse direction) of the slab 110 and are generally parallel to one another. Thus, the primary transverse grooves are aligned (e.g. parallel to) a direction y spanning from one side of the slab to another side of the slab (rather than from a front to the back of the slab).

The slab 110 comprises at least two primary transverse grooves 120, and preferably comprises at least three primary transverse grooves, more preferably at least five primary transverse grooves and yet more preferably at least ten primary transverse grooves.

The rail support arrangement 100 further comprises a plurality of rail supports 130. Each rail support 130 is mounted/positioned in a different primary transverse groove 120. There are an equal number of rail supports 130 to the number of primary transverse grooves. A rail support 130 comprises at least one projection 135 (i.e. a protrusion, flange or lip), e.g. at least a first projection 135 and optionally a second projection 136.

The projection(s) 135, 136 extend outwardly from a side wall of the primary transverse groove 120. In some examples, the projection(s) lies in a plane parallel to the plane in which the upper(most) surfaces 111 of the slab lie, e.g. lie in the same plane. In other examples, the projection(s) is angled away from the plane in which the upper(most) surfaces 111 of the slab 110 lie, e.g. angled towards a floor of the primary transverse groove. More detailed examples for the shape of the projection(s) will be described later.

A projection 135, 136 is configured to engage with a rail fastening system 160 that is positioned within a primary transverse groove. The rail fastening system 160 is able to secure a rail 190 or other piece of railway infrastructure to the projection (when the rail fastening system is positioned in the primary transverse groove). Thus, the rail fastening system can secure the rail 190, or other piece of railway infrastructure, to the rail support and therefore the slab 110. When fastened in this manner, a movement of the rail in a direction perpendicular to the direction of the primary transverse grooves (e.g. a vertical direction) is prevented/restricted. The fastening may also prevent/restrict movement in a direction of the primary transverse groove (i.e. the transverse direction), e.g. by way of friction, and/or movement in a longitudinal direction, as the side walls of the grooves prevent movement in this direction.

The direction in which the transverse grooves lies is such that when the rail is coupled to the rail support(s), the transverse grooves are angled with respect (i.e. not parallel) to the direction of the rail, and therefore are angled with respect to the direction of a vehicle travelling along the rails.

In one example, the rail fastening system 160 comprises a bolting system, in which one or more nut and bolt arrangements engage with a projection (or projections) to fasten a rail to the projection. For instance, a bolt may engage with an underside of the projection, with a nut effectively coupling the rail to an upper side of the projection. In another example, the rail fastening system may comprise a clamp for clamping the rail to the projection(s). Yet other examples may employ clips or the like. Example rail fastening systems include the "W-tram" fastening system developed by Vossloh®, the NABLA Evolution Fastening system developed by Pandrol® and/or the RailLok® system produced by Grantex®.

The use of a plurality of transverse grooves (with the respective plurality of rail supports) increases a flexibility of use for the rail support arrangement 100. In particular, a rail can be coupled (via a plurality of rail supports) to the rail support arrangement at a variety of angles (e.g. rather than in a single, fixed direction). This improves a flexibility for installing the rail support arrangement and/or positioning rails upon a rail support arrangement. For instance, a same style of rail support arrangement can be used to support rails for both straight portions of a railway track and curved portions of a railway track, avoiding the need for different styles of rail support arrangements. This reduces manufacturing complexity and cost.

The greater the number of primary transverse grooves in slab 110 (and corresponding number of rail supports), the greater the flexibility of use of the slab.

The uppermost portion of each projection is preferably in line with (i.e. in a same plane as) or (vertically) below the upper(most) surfaces 111 of the slab 110. This means that, when the rail is secured to the slab, it can be positioned to lie directly on the slab itself 110, to maximize load distribution of the weight through the slab 110. Of course, elastomeric pads or other shock absorbing pads may be positioned between the slab and the rail for improved operation.

In the illustrated example, when fastened to the slab, the rails are positioned to lie in a longitudinal direction (i.e. perpendicular to a transverse direction in which the primary transverse grooves lie). However, an advantage of the proposed rail support arrangement is that the rail can be positioned with respect to a range of angles about this longitudinal direction, e.g. ±200 or ±10°, whilst still being securable to a plurality of different rail supports. This provides flexibility of use for the positioning of the slab (e.g. in/on the ground) and the rails upon the slab (e.g. to facilitate tight bends or the like).

This advantage is achieved because the points of coupling between the rail and the slab can be changed by sliding or moving the rail fastening system within the transverse grooves, to change the angle between the rail and the transverse grooves (when viewed from above).

In the illustrated example, each primary transverse groove spans an entire width of the slab. However, in some embodiments, each primary transverse groove may span only part of the width of the slab, e.g. no less than 10%, e.g. no less than 20%, no less than 50%, no less than 60%, no less than 75%, no less than 80% or no less than 90%.

In the illustrated example, the rail support 130 spans the entire width of the primary transverse groove 120. However, it is conceivable that the rail support 130 spans only part of the primary transverse groove, e.g. no more than 50% of the primary transverse groove or no more than 90% of the transverse groove. In some examples, each primary transverse groove spans no more than 40% of the entire width of the slab, and preferably no more than 30% of the entire width of the slab.

According to some examples, each primary transverse groove may span between 10%-20%, 10%-25%, 10%-30%, 10%-40%, 10%-50%, 10%-60%, 10%-70%, 10%-75%, 10%-80%, 10%-90%, 10%-100%, 20%-25%, 20%-30%, 20%-40%, 20%-50%, 20%-60%, 20%-70%, 20%-75%, 20%-80%, 20%-90%, 20%-100%, 25%-30%, 25%-40%, 25%-50%, 25%-60%, 25%-70%, 25%-75%, 25%-80%, 25%-90%, 25%-100%, 30%-40%, 30%-50%, 30%-60%, 30%-70%, 30%-75%, 30%-80%, 30%-90%, 30%-100%, 40%-50%, 40%-60%, 40%-70%, 40%-75%, 40%-80%, 40%-90%, 40%-100%, 50%-60%, 50%-70%, 50%-75%, 50%-80%, 50%-90%, 50%-100%, 60%-70%, 60%-75%, 60%-80%, 60%-90%, 60%-100%, 70%-75%, 70%-80%, 70%-90%, 70%-100%, 75%-80%. 75%-90%. 75%-100%. 80%-90%, 80%-100%, or 90%-100% of the entire width of the slab or 100% of the entire width of the slab.

These approaches allow a rail to be secured at different positions along the lateral/transverse extent of the primary transverse grooves. This means that a rail could be secured to a different primary transverse groove at different lateral positions, i.e. so that the rail can be angled with respect to the longitudinal direction of the slab for facilitating curves.

In some examples, one or more of the rail supports 130 extend outwardly from a side of the slab. Thus, in some examples, the length of the (at least one or each) rail support is larger than the length of the primary transverse in which the rail support is placed.

This increases an ease in placing or positioning a rail fastening system into the rail support(s) and reduces a likelihood that an end of the rail support will be inaccessible, e.g. due to unintended blockage of the end of the rail support during manufacture. Extending the rail supports outwardly form a side of the slab also provides an additional path for water to flow from the slab and/or rail support arrangement. In the illustrated example, each primary transverse groove 120 is a continuous cut, groove or channel in the slab 110 and each rail support 130 is similarly a continuous structure mounted in the respective primary transverse groove 120.

However, in other examples, one or more of the primary transverse grooves may be discontinuous, i.e. formed from a plurality of groove portions. In such examples, each groove portion may be positioned along a same axis (i.e. arranged in a same direction) and mount a respective rail support portion. In this scenario, a single "primary transverse groove" is considered to include all grooves, cuts or channels that are positioned along the same, single axis. Preferably, each primary transverse groove, or one or more of the primary transverse grooves, comprises no more than 3 groove portions, for instance, no more than 2 groove portions (e.g. exactly 2 groove portions).

Purely by way of example, each primary transverse groove may comprise a first groove portion (that mounts a first rail support portion for coupling to a first rail) and a second groove portion (that mounts a second rail support portion for coupling to a second rail). Each rail portion may, for instance, have a width no less than 20% of the width of the slab 110, e.g. no less than 25% of the width of the slab, e.g. no less than 35% of the width of the slab.

This approach can, for instance, provide a gap between possible locations for the rails to account for the required gap between rails (e.g. due to a predetermined track gauge). The proposed approach can reduce the amount of material used, thereby reducing the cost of the overall rail support arrangement.

Of course, rather than considering a primary transverse groove as being a single discontinuous primary transverse groove formed of a plurality of groove portions, each discontinuous primary transverse groove may be conceptually represented as a set of primary transverse grooves, each of which lie along a same hypothetical line. In other words, each "groove portion" described above may be identified as a different "primary transverse groove".

A more detailed description of an embodiment is provided later in this disclosure.

FIG. 1 also illustrates the optional feature of one or more secondary transverse grooves 170. The secondary transverse grooves 170 are generally parallel to each of the first transverse grooves, but do not mount any rail supports (e.g. are unable to mount or connect to a rail or other piece of railway infrastructure).

The secondary transverse grooves are configured to allow or facilitate welding and/or maintenance of a rail, or other railway infrastructure (which may hereafter be an alternative for a "rail" where appropriate), coupled to the rail supports (mounted in the primary transverse grooves). In particular, the secondary transverse grooves facilitate access to the underside of a rail mounted on the slab, e.g. to facilitate welding of two rails together at the location of the secondary transverse groove.

In some examples, the depth of each secondary transverse groove is greater than the depth of each primary transverse groove. In some examples, the width of each secondary transverse groove is greater than the width of each primary transverse groove. When referencing a groove, the width in considered to span in the longitudinal or length direction of the slab 110. The differing width aids in distinguishing the grooves from one another, whilst also maximizing an area for performing welding/maintenance on the rails.

It is not essential that the secondary transverse groove(s) has/have an oblong cross-section as illustrated. For instance, in some embodiments, each secondary transverse groove has a triangular cross-section (e.g. with the base of the triangle being in line with the uppermost surface(s) of the slab 110) or a frustum cross-section.

The distance between each secondary transverse groove 170 may be no less than 0.75 m, for instance, no less than 1 m. It is recognized that the secondary transverse grooves will inherently introduce some weakness in the slab 110, so that a minimum distance reduces the impact of such weakness. In some examples, the distance is no more than 2 m (e.g. between 0.75 m and 2 m, between 1 m and 2 m and so on), to facilitate ease of welding and achieve the advantages set out below.

The use of secondary transverse grooves also facilitates the removal of only part of the rail(s) and the rail support arrangement (e.g. if there is a need to access below the rail support arrangement, e.g. for accessing utilities or the like). In particular, the rails and the rail support arrangement can be cut between two secondary transverse grooves, any necessary access operations performed, and the removed part of the rail support arrangement replaced (e.g. with a new rail support arrangement or the previously removed part). The secondary transverse grooves facilitate reinstatement or installation of the rails, by welding the rails at the secondary transverse grooves.

The sides (side surfaces) of the slab 110 may be slanted (i.e. not at 0° or 90°) or perpendicular to the upper surface of the slab 110. In the illustrated example, the side surfaces are perpendicular to the supper surface. However, in other examples, the side surfaces may be slanted or angled. In some instances, the side surfaces will be partly slanted, and partly perpendicular to the upper surface of the slab 110. For instance, the side surfaces may initially slant or be angled away from the upper surface, before becoming perpendicular towards the base of the slab.

A slanted or partially slanted slab reduces the likelihood of reflective cracking failure of any surrounding pavement material (e.g. that embeds the rail support arrangement within a highway). It will also aid with the release of the (cast) slab (e.g. from the mold) during manufacture.

As previously explained, the slab 110 may be formed of any suitable material for supporting a rail. Preferably, the slab 110 is formed of a cement composite, such as concrete. Even more preferably, the slab is formed of a fiber reinforced concrete. Yet more preferably, the slab is formed of an ultra-high performance fiber reinforced concrete (UHPFRC). UHPFRC has a standardized ruleset, e.g. as set out in the French standard NF P 18-710, "National Addition to Eurocode 2—Design of Concrete Structures: Specific Rules for Ultra-High Performance Fiber-Reinforced Concrete (UHPFRC)".

Use of high performance materials, such as UHPFRC, facilitates the manufacture of relatively thin slabs (i.e. slabs having a reduced height compared to conventional slabs). This has the distinct advantage of allowing slab-based rail systems to be installed over existing utilities, and with reduced excavation requirements for installment, meaning that the construction of a railway system is cheaper, quicker and less destructive to existing infrastructure (such as existing utilities and the like).

Unlike steel reinforced or pre-stressed concrete, slabs formed of fiber reinforced concrete are able to be cut on-site without significantly reducing the overall structural resistance of the slab. In particular, for fiber reinforced concrete, the loss of structural resistance is gradual and proportional to the volume of material removed (rather than a step change in, say, steel reinforced concrete). This property allows increased flexibility in cutting the slab during installation in order to accommodate curves in the track and existing utility access holes, and after installation in order to remove part of a slab for maintenance purposes—without having a significant impact on the structural integrity of the slab.

The use of a cement-composite, such as concrete, also facilitates ease of manufacturing, through the use of cast molds and the like.

The slab may have a height of no more than 15 cm, for instance, no more than 11 cm (e.g. around 10 cm). This relatively small height can be achieved through selection of appropriate materials having suitable stress properties (e.g. having suitable fatigue resistance and/or flexural resistance) for supporting a rail system (and any rolling stock) thereon. One example of a suitable material is UHPFRC.

The present disclosure recognizes that suitable selection of materials facilitates the use of low-thickness (i.e. small height) slabs for railway infrastructure. Thin slabs allow for placement of railway infrastructure on existing utilities (e.g. electricity, water, fiber, gas services and so on) and reduce construction costs, as less excavation is required. This is of particular advantage in an urban environment, by reducing the number of stakeholders with whom a railway installer is required to liaise.

The proposed approach also aids in avoiding or reducing the utility diversion costs that might otherwise be needed, which would significantly reduce the overall construction duration. The proposed approach should also significantly reduce project risk (and hence the required contingency) that is typically associated with large-scale infrastructure projects.

The use of thin slabs also facilitates ease of access to areas below the rail support arrangement (e.g. to access utilities and the like).

Preferably, the slab is configured to have a fatigue resistance or perpetual flexural fatigue strength of no less than 2.5 MPa, e.g. no less than 3 MPa, e.g. no less than 3.25 MPa. In some examples, the slab has a perpetual flexural fatigue strength of no less than 5 MPa, e.g. no less than 7 MPa. This is considered to be sufficient to allow both the support of rolling stock (on tracks mounted on the slab) as well as vehicular traffic to be supported by the slab without breaking. A perpetual flexural fatigue strength of no less than 7 MPa may, for instance, facilitate cutouts to be formed in the slab (e.g. for providing utility access or the like) without affecting the capability of the slab to support rail-based traffic.

Additional perpetual flexural fatigue strength would provide additional safety limits, which may be desirable for future-proofing any rail installations.

Preferably, the slab is configured to have a fatigue resistance or perpetual flexural fatigue strength of no less than 2.5 MPa, e.g. no less than 3 MPa, e.g. no less than 3.25 MPa. In some examples, the slab has a perpetual flexural fatigue strength of no less than 5 MPa, e.g. no less than 7 MPa.

The perpetual flexural fatigue strength of a slab can be measured using a three-point flexural test or center point load test. Examples of these tests are well known and include the following standards: ASTM C78, ASTM C293 and/or BS EN 12390-5. Other suitable examples would be readily apparent to the skilled person.

The slab may have a length of no more than 12 m, for example, no more than 8 m. Preferably, the slab has a length of no more than 4 m. For example, the slab may have a length of 3 m (measured within a practicable or reasonable margin of error, e.g. ±0.1 m).

The short length and height of the slab (relative to a conventional slab) reduces the weight of the slab, facilitating ease of installation, and thus reducing the cost of installation, of the rail support arrangement. The reduced weight improves the ease and reduces the cost of handling and transporting the slabs.

The rail supports, and in particular the projections of the rail supports, may be formed of any suitable material for mounting a rail thereon, such as metal (e.g. steel, iron, steel alloy and so on). Other suitable materials will be apparent to the skilled person, e.g. metal composites or the like.

The slab 110 may comprise one or more through-holes, i.e. holes that span an entire height of the slab 110. These through-holes allow the rail support system to be lifted and moved, e.g. for the purposes of installation, removal and/or replacement of the rail support system. In particular, at least one of the through-holes may be threaded to allow rods/screws to pass therethrough in order to facilitate a slight raising of the rail support system (e.g. when it is positioned on the ground). This can allow, as will be later described, bedding material to be cast or poured beneath the rail support arrangement.

The slab 110 may comprise one or more water drainage or seepage holes, being holes that span the entire height of the slab to facilitate or allow the exit of water from the slab, e.g. water drainage through the slab. These water drainage or seepage holes may have a diameter no greater than 25 mm. A seepage hole may alternatively be labelled a weepage or weep hole. Water drainage or seepage holes may also facilitate ventilation of the slab or components thereon.

The water draining or seepage holes are particularly advantageous when the slab is formed of UHPC, which tends to be impermeable or of very little permeance (compared to conventional concrete), in order to avoid the collection of water on the upper surface of the slab.

The water draining or seepage holes are also advantageous when, following installation, the rail support arrangement is coated with pavement or surface course (e.g. asphalt), as described in later examples. The holes help avoid water stagnation at the interface between the slab and the pavement or surface course, and thereby improve a longevity of the installed rail support arrangement.

Figure 2:
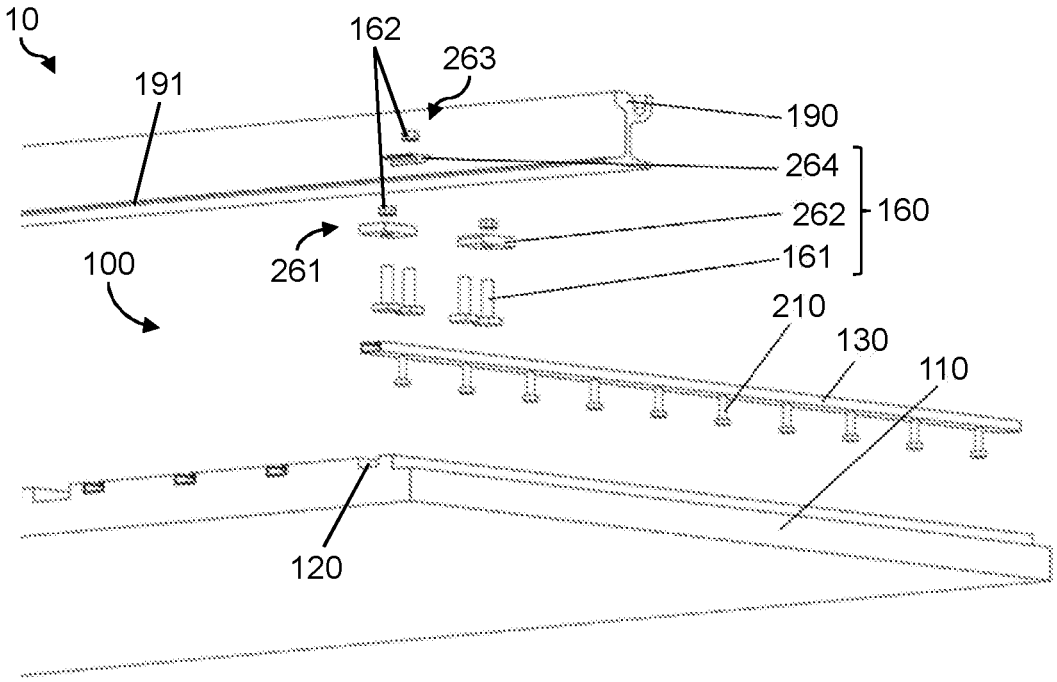
FIG. 2 provides an exploded view of the rail support arrangement.

FIG. 2 provides an exploded view of the rail system 10, including the rail support arrangement 100, for the sake of improved understanding.

FIG. 2 provides an illustrative example of how the rails supports 130 are connected or mounted in the respective primary transverse grooves 120—i.e. how the rail support are secured to the slab 110.

In particular, each rail support 130 comprises a plurality of elongate anchors 210 (e.g. projections or the like). Each elongate anchor 210 is configured to protrude into the slab 110, to thereby secure the rail support to the slab. Thus, the plurality of elongate anchors 210 mount a rail support 130 within a respective primary transverse groove 120. Put another way, the elongate anchors 210 embed the rail support(s) into the transverse grooves.

The elongate anchors may comprise, at the end protruding into the slab, a flared or projecting base, e.g. a base that extends outwardly, laterally or sideways from the direction of the elongate anchor. This reduces a likelihood that the elongate anchor will dislodge or be otherwise removed from the slab. An elongate anchor having a length of between 40-60 mm has been identified as providing sufficient structural integrity for a rail support (formed of the same material as the rest of the rail support). However, the skilled person will appreciate that other lengths and dimensions are possible, e.g. depending upon the materials of the slab and/or the rail support.

FIG. 2 also illustrates the elements of a rail fastening system 160 for securing a rail 190 to the rail support 130.

The rail fastening system comprises one or more bolts 161. The bolts are sized to fit within a primary transverse groove and engage or abut one or more projections 135, 136 of the rail support 130. A respective one or more nuts 162 can be used to secure the rail (or other piece of railway infrastructure) to the projection (e.g. by engaging with or abutting another side of the projection).

In the illustrated example, a first nut and bolt arrangement 261 couples a lateral blocker 262 to the rail support. A second nut and bolt arrangement 263 couples a fastener 264 to a projection/flange 191 of the rail and to the lateral blocker 262. In this way, the second nut and bolt arrangement 263 effectively clamps the flange of the rail to the rail support by pressing the fastener 264 against the projection/flange 191 of the rail and the lateral blocker 262. This effectively prevents or restricts a vertical movement of the rail with respect to the rail support arrangement.

The lateral blocker(s) 262 may be configured to prevent or restrict a movement of the rail in a direction of the primary transverse groove(s), i.e. laterally.

The other side of the rail is secured to the rail support 130 in the same manner.

The shape of the fastener 264 is configured to complement a shape of the projection/flange 191 of the rail, e.g. to fit tightly/snuggly against the projection/flange 191 of the rail. The fastening systems are also configured to be rotatable, so as to allow the rail 190 to be positioned at a number of angles with respect to the upper(most) surfaces of the slab 110, whilst still being secured thereto.

Figure 3:
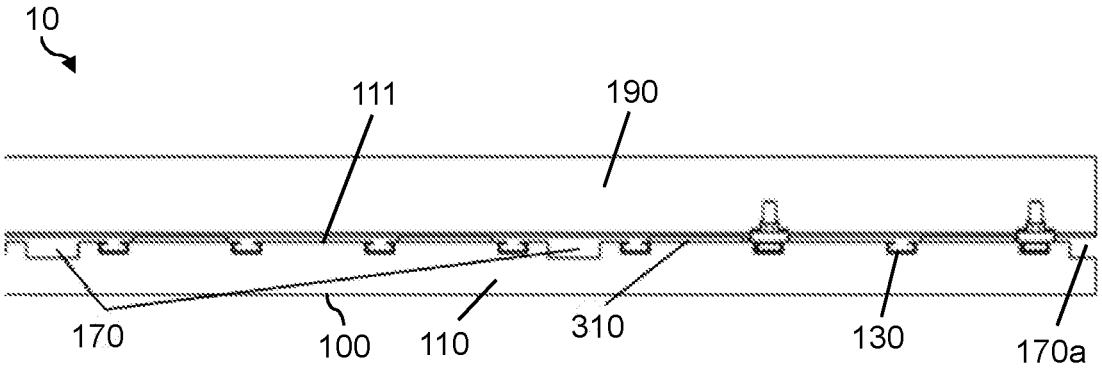
FIG. 3 provides a side view of the rail support arrangement.

FIG. 3 illustrates a side view of the rail system 10, i.e. a view taken from a side of the rail support arrangement.

The side view more clearly illustrates the relationship between primary and secondary transverse grooves according to some embodiments, demonstrating how the secondary transverse grooves may be wider/deeper than the primary transverse grooves.

The width and depth of the secondary transverse grooves are configured to allow sufficient space around a rail coupled to the rail support arrangement for welding the rail. The width and depth of the secondary transverse grooves may be based on the dimensions of a welding apparatus. For example, the width and depth of the secondary transverse grooves may be configured to allow a mold to fit under the rail without removing the rail from the rail support arrangement.

In FIG. 3, secondary transverse grooves 170 are provided at intervals along the rail support arrangement, and at an end of the rail support arrangement. The secondary transverse groove 170*a* at the end of the rail support arrangement has only one side wall; that is, the groove provides a stepped edge to the rail support arrangement. This groove has a smaller width than the other secondary transverse grooves; a similar groove at an end of an adjacent rail support arrangement may together with this groove provide a full-width secondary transverse groove. This allows rails coupled to two rail support arrangements to be welded at the join between the rail support arrangements.

FIG. 3 also illustrates the use of elastomeric pads 310 between a rail 190 and an upper surface 111 of the slab 110. The elastomeric pads act as shock absorbers and reduce vibrations of the rail 190. The elastomeric pads may be provided between the rail and the slab at fastening locations (that is, locations at which a fastening system couples the rail to a rail support 130) in order to reduce wear of the rail 190 and rail support arrangement 10. Of course, some elastomeric pads may be provided across the entire upper surface 111 of the slab 110.

The side view also more clearly illustrates a possible shape of the rail supports 130, and, in particular, of the projections 135, 136 of the rail supports. Each rail support 13 shown in FIG. 3 has parallel sides that are perpendicular to the base, and two projections, one extending from each side of the rail support towards the other. The projections are perpendicular to the sides of the rail support 130. The projections 135, 136 are configured to provide a surface against which a head of a bolt can engage, while a gap between the projections allows a body/thread of a bolt to extend outwardly from an upper surface of the rail support. The upper surfaces of the projections 135, 136 lie flush with the upper(most) surfaces 111 of the slab 110, allowing a lateral blocker to fit against both the projections and the upper(most) surfaces of the slab. However, in other examples, the upper(most) surfaces of the projections may lie below the upper(most) surfaces 111 of the slab 110.

Figure 4:
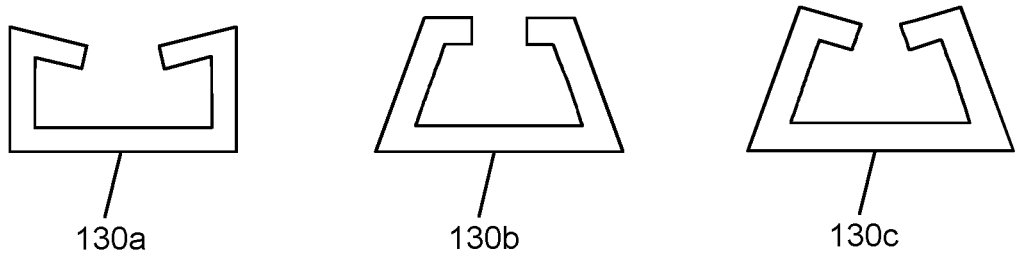
FIG. 4 provides example shapes of a rail support.

FIG. 4 illustrates example alternative shapes 130*a*, 130*b* and 130*c* for the rail supports 130 to the shape shown in FIG. 3. FIG. 4 shows the shapes of the rail supports from a side view of a rail support arrangement. Rail support 130*a* has sides that are perpendicular to the base, and two projections extending from the sides angled down towards the base. Rail support 130*b* has sides or sidewalls that are angled towards each other, which may more securely embed the rail support in the slab 110, and two projections that are parallel to the base. Rail support 130*c* has sides or sidewalls that are angled towards each other, and two projections that are angled downwards relative a plane parallel to the base.

Angled sidewalls, as illustrated by rail supports 130*b* and 130*c*, facilitate improved grip to a bolt positioned within the rail support 130, e.g. because as the bolt is tightened it will be further secured against the sidewalls, e.g. to have more points of contact with the rail support 130.

Figure 5:
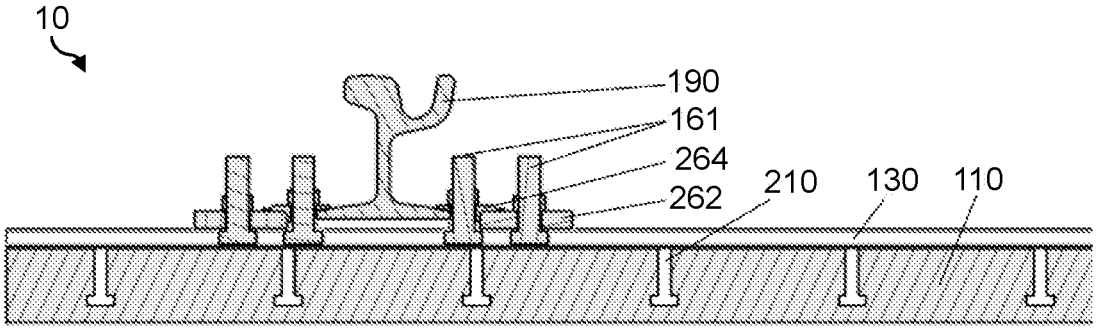
FIG. 5 provides a frontal view of part of the rail support arrangement.

FIG. 5 illustrates a front cross-section of the rail system 10, i.e. a cross-section that lies within a vertical plane across a width of the rail support arrangement.

The front cross-section more clearly illustrates an embodiment for the plurality of elongate anchors 210 (an optional feature), which embed each rail support 130 into a respective primary transverse groove.

Figure 6:
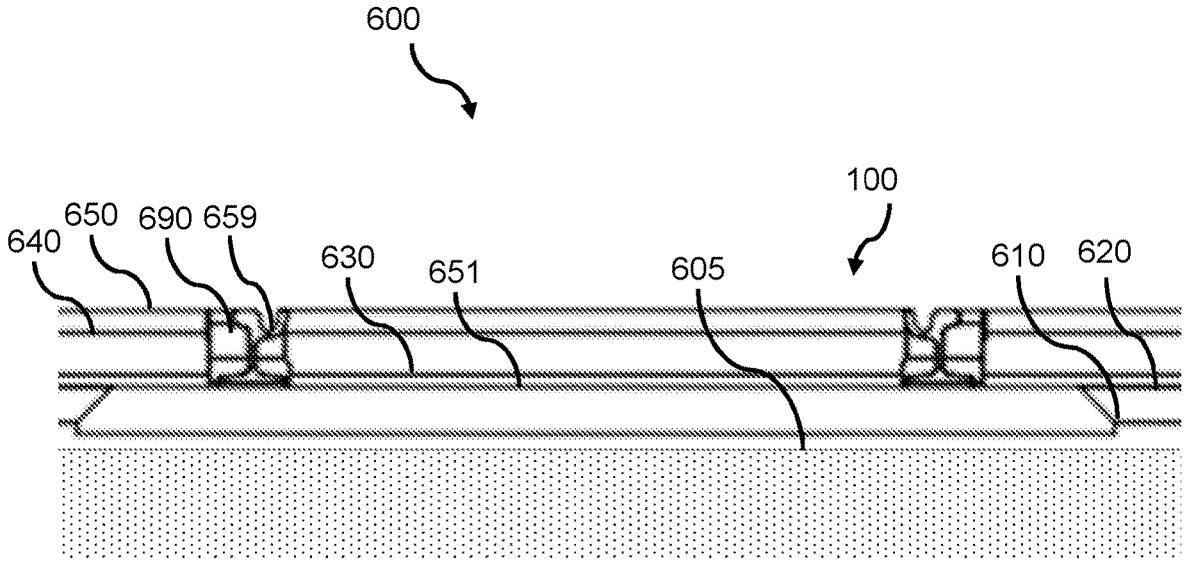
FIG. 6 illustrates the rail support arrangement following installation to form railway infrastructure.

The front cross-section also more clearly illustrates an embodiment of the rail fastening system 160, in which two nut and bolt arrangements effectively clamp a rail 190 to the rail support via a fastener 264 and a lateral blocker 262. In particular, the front cross-section illustrates how the lateral blocker may be shaped to provide a stand for the fastener. The lateral blocker and the fastener have complementary geometry, enabling the fastener to securely fit against the lateral blocker. This approach provides a rail fastening system FIG. 6 illustrates a rail installation 600, in which a rail support arrangement 100 has been installed by performing a method according to an embodiment of the present disclosure.

The rail support arrangement 100 may be embodied as any herein described rail support arrangement, although other forms of rail support arrangement will be apparent to the skilled person. The rail support arrangement comprises a slab 651 and a plurality of rail supports mounted in the slab to which one or more rails 659 can be connected.

Preferably, the slab is configured to have a fatigue resistance or perpetual flexural fatigue strength of no less than 2.5 MPa, e.g. no less than 3 MPa, e.g. no less than 3.25 MPa. In some examples, the slab has a perpetual flexural fatigue strength of no less than 5 MPa, e.g. no less than 7 MPa.

The perpetual flexural fatigue strength of a slab can be measured using a three-point flexural test or center point load test. Examples of these tests are well known and include the following standards: ASTM C78, ASTM C293 and/or BS EN 12390-5. Other suitable examples would be readily apparent to the skilled person.

The rail installation 600 comprises a bedding layer 610. The bedding layer is provided directly onto compacted ground 605 (partially illustrated using stippling) at an installation area. The bedding layer may be formed, for instance, of a cement mortar or cement based composite. Alternatively, the bedding layer may be formed of a geopolymer, such as an expanding geopolymer, or the like. In particular, the bedding layer may be formed of a controlled low strength material. Other suitable materials for a bedding layer will be apparent, but the bedding layer should be formed of a material that can mount the slab of the rail support arrangement.

One particularly suitable material might be an expanding material, such as an expanding geopolymer. Not only would this provide suitable leveling capabilities for the rail installation, but might also be used to ready "fill-in" or support any gaps, crevices and/or discontinuities in the installation area.

The rail support arrangement 100 is mounted to the bedding layer 610. For instance, the rail support arrangement may be set around the rail support arrangement and/or embedded within the bedding layer.

The bedding layer 610 may be installed, for instance, by first positioning the rail support arrangement at a desired location over compacted ground, slightly lifting the rail support arrangement (e.g. using screws through threaded holes in the slab of the rail support arrangement) and casting the bedding layer 610 underneath the slab, e.g. through one or more bedding layer pouring holes located in the slab and/or around a side of the slab. Thus, in some embodiments, a slab may comprise one or more bedding layer pouring holes configured to allow bedding material to be poured therethrough.

The bedding layer may have a thickness of less than 100 mm, e.g. less than 50 mm, e.g. less than 30 mm. In this way, the bedding layer does not provide substantial support for the slab or rail-based vehicles travelling over the slab, but rather serves to aid in the positioning of the slab at a desired location.

Thus, the maximum distance between the slab and the compacted ground may be no more than 100 mm, e.g. less than 50 mm, e.g. less than 30 mm.

Other approaches for installing a rail support arrangement in/on a bedding layer will be apparent to the skilled person, e.g. by placing a rail support arrangement upon a partially set bedding layer. Yet other approaches will be described later in this disclosure.

Rails 659 may be coupled to the rail support arrangement, e.g. through the use of one or more rail fastening systems as previously described. Part or all of each of the one or more rail fastening systems may be affixed to, set in or arranged on the rail support arrangement prior to installation in order to increase an efficiency of installation. Adjustments may then be made to the one or more rail fastening systems once the rail support arrangement has been installed in order to couple the rails to the rail support arrangement.

In some preferred examples, each rail 659 is coated or held in a rail jacket 690 or rail encapsulating surround, which may be formed of a flexible or elastic material. The rail jacket 690 thereby encapsulates each rail. The rail jacket may be formed from a rubber-based compound, although other suitable examples of flexible or elastic material would be apparent to the skilled person. The rail jacket acts to effectively isolate or (at least partially) structurally decouple the rail from the surrounding material. More specifically, the rail will be deflected or flex (e.g. vertically) when a rail-based vehicle passes over the rail. The (flexible) rail jacket acts to help decouple this movement from the main pavement materials, and reduce the impact of passing rail traffic on the pavement. A rail jacket may also be configured, for instance, to protect the rail(s) from the elements and/or water ingress, e.g. to reduce rusting of the rails.

The rail installation 600 further comprises a first layer 620 of course. The first layer of course is positioned so that its upper surface lies in a same plane as a plane in which the uppermost surface of the slab (or rail support arrangement) lies. In this way, the first layer of course is effectively level with the upper surface of the slab.

The rail installation 600 further comprises a stress absorbing membrane 630. The stress absorbing membrane 630 is positioned to lie on any exposed parts of the slab and the first layer of course. The stress absorbing membrane is useful for at least partially absorbing a stress of traffic passing over the rail support arrangement. More particularly, one intended purpose of the stress absorbing membrane is to protect the other structural elements of the rail installation from passing traffic and/or thermal expansion and/or water ingress. The membrane 630 acts as a high strain resistance layer, to reduce or limit the stresses imposed on the other layers of the rail installation. A suitable material for forming a stress absorbing membrane 630 would be a fine graded asphalt containing a high proportion of premium Polymer Modified Binder (PMB). One suitable example is the ULTILAYER SAMI produced by Tarmac®, although other examples would be apparent to the skilled person.

The rail installation further comprises a second layer 640 of course. The second layer 640 of course may effectively embed or surround rails supported by the rail support arrangement.

Example materials for the first and/or second layers of course include compacted base course and/or construction aggregate, e.g. aggregate according to the EN 13242 standard issued by the European Committee for Standardization. Other suitable materials will be readily apparent to the person skilled in the art.

In some examples, the stress absorbing layer 630 is omitted, and the first 620 and second 640 layers of course can form a single layer of course.

The rail installation 600 further comprises a layer 650 of surface or pavement course on top of the second layer of course. Surface course is sometimes alternatively labelled wearing course. The layer 650 may be configured, if the rail installation 600 is positioned within an existing roadway, to have an uppermost surface in a same plane as the uppermost surface of any surrounding roadway.

Suitable example materials for the layer 650 of surface or pavement course include macadam, tarmacadam, concrete or asphalt, such as hot rolled asphalt (HRA), stone-matrix asphalt (SMA), dense graded asphalt (DGA) and so on. Other materials suitable for forming a surface or pavement course would be readily apparent to the person skilled in the art.

In some preferred embodiments, the rail system installation 600 is configured to allow other vehicular/pedestrian traffic to move over the rail system installation. This can be achieved by configured or providing the layer 650, which may which reaches no higher than the top edge of the rail (thereby still allowing a rail-based vehicle to make contact with the rail). The pavement layer may be formed, for instance, from macadam or another suitable material (e.g. asphalt, tarmacadam or the like).

Although not illustrated, one or more binder layers may be provided to bind the layers of (surface) course within the rail installation. The binder layer may, for instance, be formed of dense macadam. Other suitable materials would be readily apparent to the skilled person.

The proposed rail installation can be made relatively shallow or short, which is particularly advantageous for installation in existing road systems.

As a working example, the bedding layer may have a height of 65 mm, the slab may have a height of 100 mm, the first layer may have a height of 85 mm, the stress absorbing membrane may have a height of 25 mm, the second layer may have a height of 100 mm and the layer of surface course may have a height of 45 mm. The total height of the rail installation may be 300 mm (meaning that a maximum excavation or milling depth of no more than 300 mm is required).

Layers 620, 630, 640 and 650 may be omitted in some embodiments, e.g. if the rail installation does not need to carry or support non-rail vehicular traffic. This may be the case if, for instance, the rail installation is to go in an area or zone in which non-rail vehicular traffic will not be present, e.g. a segregated or dedicated rail area.

Figure 7:
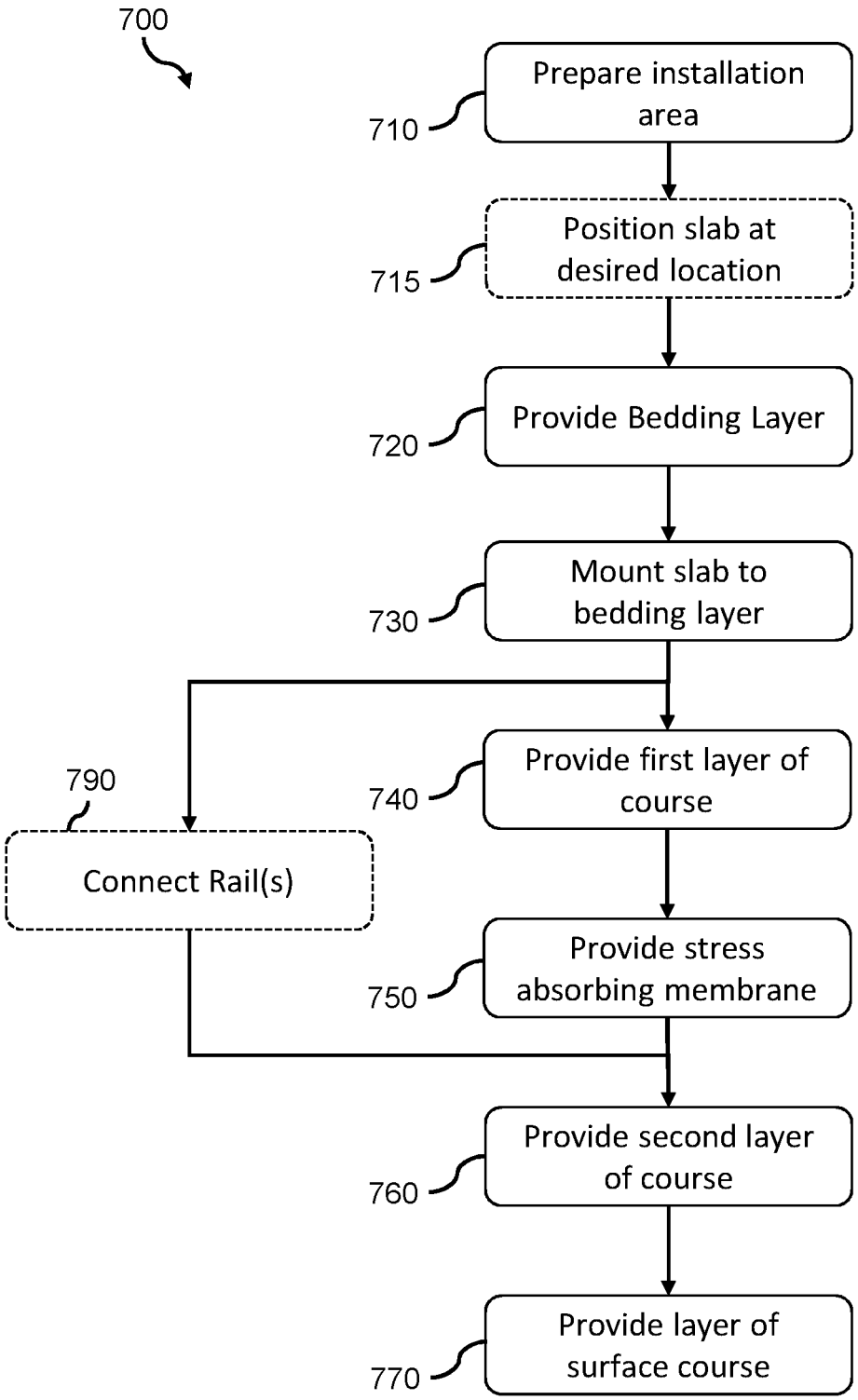
FIG. 7 is a flowchart illustrating a method of installing a rail support arrangement.

FIG. 7 illustrates a method 700 for installing a rail support arrangement according to one or more embodiments of the invention. As previously explained, the rail support arrangement comprises a slab and a plurality of rail supports mounted in the slab to which one or more rails can be connected or mounted.

The method 700 can be performed without the need to provide a thick (e.g. >100 mm) layer of hydraulically bound material, such as concrete. Thus, the method 700 may comprise performing all the steps for installing of a rail support arrangement without providing a thick (e.g. >100 mm) layer of hydraulically bound material.

The method 700 comprises a step 710 of preparing an installation area, which is an area to which the rail support arrangement is to be installed. The installation area is formed of compacted ground, i.e. ground that has been compacted to reduce the natural space between particles of the ground.

In particularly advantageous examples, step 710 comprises excavating or milling from a road surface to define the installation area. The ground beneath a road surface is naturally compacted, as a result of the road preparation procedure and/or historic vehicular traffic over the road surface (which weights or presses down on the ground beneath the road surface).

In excavating the road surface, the maximum depth of the excavation may be no greater than 400 mm, e.g. no greater than 350 mm. Embodiments recognize that the use of a slab (and particularly a slab of high fatigue resistance or load bearing capacity) facilitates relatively shallow excavations whilst still allowing for the installation and operation of rail infrastructure. A shallow excavation depth means that existing utilities (such as sewage, water, electricity, communications and so on) can be undisturbed, improving installation time and reducing an impact on individuals in the vicinity. This is because utilities are typically installed at much greater depths than such excavation depths.

Of course, if necessary, step 710 may comprise a process of compacting ground (e.g. using a roadroller or the like). This may be necessary if the rail support arrangement is to be provided at a location at which no road surface is available.

In some examples, step 710 may comprise performing further assessment and/or treatment of the installation area, e.g. to aid with the practicalities of installation.

In one example, step 710 may comprise obtaining a ground condition measurement (such as a California bearing ratio (CBR) measurement). If the ground conditions are weak and/or beyond the design specifications, local reinforcement techniques commonly used in the industry can be applied. In these cases, the remaining steps of the method may not be performed, and an alternative approach for installing the rail support arrangement could be used.

In some examples, step 710 may comprise providing a treatment or sealant layer on top of the compacted ground. The treatment layer may, for instance, comprise a thin (e.g. 5-10 mm) layer of fine aggregate mixed with a binder on top of the compacted ground. This can aid in ease of installation, e.g. providing a cleaner working environment if the ground is clay-like or muddy and/or smoothing a rough/non-uniform compacted ground surface. The latter advantage improves a cost-efficiency of the rail installation process, rather than relying any differences in level to be filled with the bedding layer as later described.

To save cost, material and installation difficulty, the treatment layer should have no/negligible impact on the structural support provided by the compacted ground, rather serving only to aid in the ease of installation and reduction in costs of other material.

Preferably, the installation area does not comprise a thick (e.g. >100 mm) layer of hydraulically bound material, such as concrete. Embodiments have advantageously recognized that the proposed approach for installation of a rail support arrangement do not require such a layer of hydraulically bound material, which has previously been considered essential to correct installation of a rail support arrangement for long-term security.

The method 700 may then perform a step 720 of providing, directly onto the compacted ground of the installation area, a bedding layer for mounting to the slab of the rail support arrangement. Thus, the bedding layer (into/onto which the slab is mounted or embedded) is located directly upon compacted soil or ground, rather than another supporting structure (such as a layer of concrete). Suitable examples of bedding layers have been previously described.

In the context of the present disclosure, the compacted ground may be considered to include treated compacted ground, e.g. compacted ground to which a relatively thin treatment layer (e.g. <50 mm or <20 mm thick) has been applied. By way of example, compacted ground to which a thin treatment layer has been applied will provided substantially the same structural support as untreated compacted ground (but with increased ease of installation and/or reduced costs of installation of further layers).

Thus, if the compacted ground is treated with a treatment layer, step 720 may only be considered to have been performed according to the present disclosure if a maximum distance between the bedding layer and the compacted ground is less than 50 mm, e.g. less than 20 mm. For untreated compacted ground, step 720 is performed if the bedding layer makes direct contact with the compacted ground.

The method 700 then comprises a step 730 of mounting the slab of the rail support arrangement to the bedding layer, to thereby install the rail support arrangement. Step 730 may comprise embedding the slab into the bedding layer, e.g. so that a plane in which an uppermost surface of the bedding layer lies is vertically above the plane in which the lowermost surface of the slab lies. Alternatively, step 730 may comprise positioning the slab on top of the bedding layer.

Alternatively and preferably, steps 720 and 730 may be performed using a same process, e.g. near-simultaneously. This can be achieved by performing an optional step 715 of positioning the slab at a desired (vertical) location with respect to the installation area. The bedding material can then be injected or pumped directly onto the compacted ground of the installation area beneath the slab to secure the slab in place, i.e. to mount the slab to the bedding layer. This step of injecting or pumping the bedding material beneath a slab (at a desired location) effectively performs steps 720 and 730 at a same time.

Step 715 could be performed by suspending the slab from a crane or other lifting arrangement, e.g. via one or more through-holes located in the slab. Suitable examples of such through-holes are provided later in this disclosure, and may comprise threaded through-holes.

As another example, steps 720 and 730 could be performed by first positioning the slabs on the installation area, e.g. instead of performing step 715, at a desired location in a horizontal plane. The bedding layer may then be provided, in steps 720 and 730 directly beneath the slab in order to lift the slab into a desired (vertical) location with respect to the installation area, to thereby lift the slabs to a desired position in a vertical plane. This process may also facilitate tilting of the slab, e.g. for water runoff. In this approach, providing the bedding layer may be performed by pumping or injecting the bedding layer material beneath the slab. Suitable examples of appropriate material would include geopolymers.

Other approaches for installing a (slab of a) rail support arrangement in/on a bedding layer have been previously described, e.g. by casting the bedding layer beneath a partially raised slab or placing a rail support arrangement upon a partially set bedding layer. These provide examples for performing steps 720 and 730.

The method may then move to a step 740 of providing a first layer of course on top of any and all exposed parts of the bedding layer. This first layer of course may level the ground surrounding the slab to a same level as the slab. Thus, the uppermost surface of the first layer of course may lie in a same plane as the uppermost surface of the slab.

After step 740, the method 700 may perform a step 750 of providing a stress absorbing membrane layer on top of any (e.g. and all) exposed parts of the slab and/or the first layer of course.

The method may then move to a step 760 of providing a second layer of course on top of the stress absorbing membrane layer.

Of course, in some examples, step 750 is omitted and the first and second layers of course may be applied at a same time (e.g. to form a single layer of course). Thus, in some examples of embodiments in which step 750 is omitted from the method 700, step 740 and 760 are performed at a same time.

The method may then move to a step 770 of providing a layer of surface or pavement course on top of the second layer of course. Suitable examples of surface or pavement course have been previously described.

Step 770 may be configured such that the uppermost surface of the layer of surface or pavement course is in a same plane as the uppermost surfaces of nearby surface or pavement courses (e.g. surface or pavement courses of roadways in which the rail support arrangement is to be installed).

The method 700 may, of course, comprise a step 790 of securing one or more rails to the plurality of rail supports. The step 790 can be performed after the rail support arrangement has been mounted to the slab in step 730, but should be performed before the second layer of course is provided in step 760.

If step 710 comprises excavating or milling from a road surface to define the installation area, then step 790 may be performed such that the uppermost part of the plurality of rails lies in or below the plane in which the uppermost surface of the unexcavated or non-milled road surface lies. This approach may be achieved through appropriate selection of excavation depth, bedding layer height, slab height and/or rail height.

In some circumstances, steps 740, 750, 760 and 770 can be omitted. For instance, if the rail installation would be positioned in a dedicated or segregated area (i.e. only the rail vehicle will use it), then provision of the additional layers for supporting or facilitating the transport of vehicular (non-rail) traffic is not necessary.

The proposed method 700 for installing a rail support arrangement is particularly advantageous in the context of a light rail transportation system. In light rail transportation systems, the weight of the rail-based vehicles is significantly reduced compared to conventional rail systems. This means that use of a concrete base layer, or base layer made of some other hydraulically bound material, can be avoided through use of a suitable slab.

In particular, if the slab is made of a high strength material, such as fiber reinforced concrete and more particularly ultra-high performance fiber reinforced concrete, then the intrinsic strength of a slab.

Use of such materials also means that a relatively thin slab can be provided, meaning that an excavation depth can be further reduced, e.g. to no more than 400 mm. This can facilitate installation of rail infrastructure within existing road or vehicular infrastructure without impacting existing utilities (e.g. electricity, water, sewerage etc.) that typically lie beneath existing road infrastructure.

Figure 8:
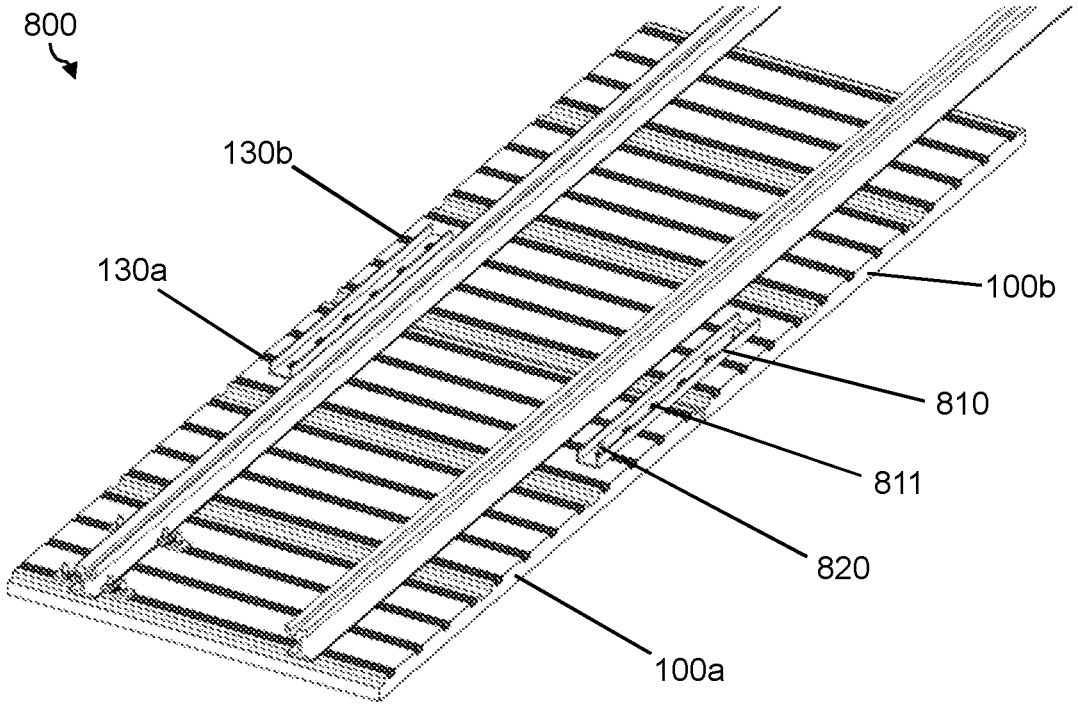
FIG. 8 illustrates a perspective view of a rail support system.

FIG. 8 illustrates a rail support system 800 for use in an embodiment of the invention. The rail support system comprises a first rail support arrangement 100*a*, a second rail support arrangement 100*b* and a stiffening bar 810 that couples the first rail support arrangement to the second support arrangement.

In some examples, the rail support arrangement 100*a*, 100*b* is shorter than conventional slab tracks. It may therefore be desirable to add a stiffening bar as an anti-bouncing device, transferring shear stress between the slabs to effectively provide a continuous-slab equivalent. This is particularly desirable in cases where the slab is expected to support HGV traffic. The rails also act as anti-bouncing devices, and may be sufficient for providing an effective continuous-slab equivalent in some examples.

The stiffening bar 810 is coupled to a first rail support 130*a* of the first support arrangement 100*a* and to a second rail support 130*b* of the second support arrangement. In FIG. 8, the stiffening bar comprises a plurality of slots 811 to allow the stiffening bar to be secured to the rail supports, and is coupled to each rail support using a nut and bolt arrangement 820. A bolt engages with one or more projections 135, 136 of a rail support, is threaded through one of the slots 811 of the stiffening bar, and is secured by a nut. Other examples may use alternative fastening systems, such as clamps, clips and so on, to couple the stiffening bar to the rail supports.

The stiffening bar may be made of any material suitable for distributing shear stress between slabs, such as a metal (e.g., steel, steel alloy and so on). The stiffening bar may be a U-shaped beam, for improved (shear) resistance compared to a flat beam. For example, a BSI Steel Channel taper beam may be used as a stiffening bar. In other examples, a planar stiffening bar could be used.

Figure 9:
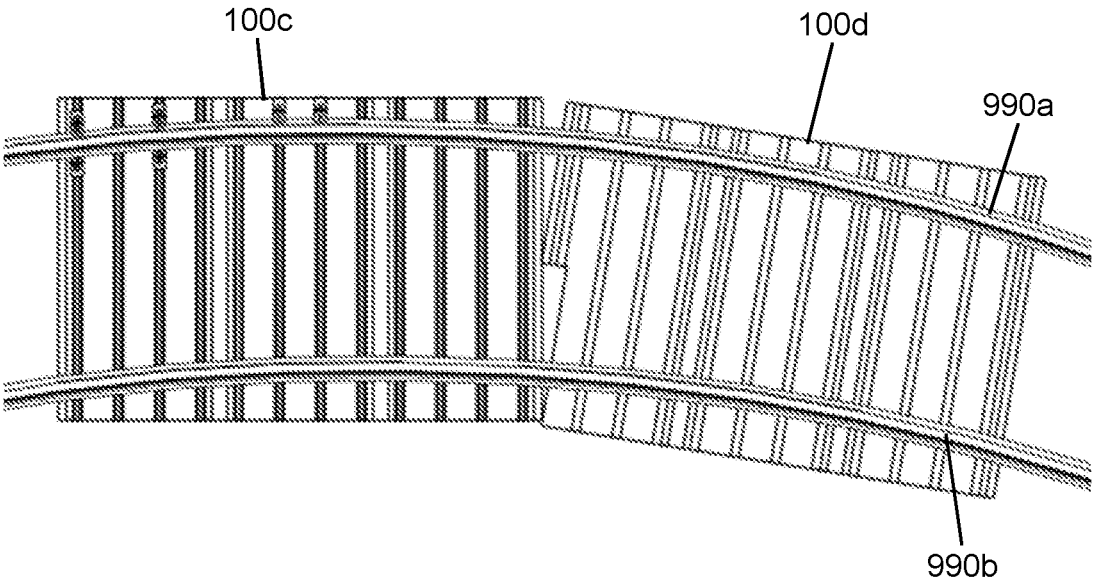
FIG. 9 illustrates a rail support arrangement at a curved section of track.

FIG. 9 illustrates the rail system at a curved section of track. FIG. 9 shows a first rail support arrangement 100*c*, a second rail support arrangement 100*d* and two curved rails 990*a* and 990*b*.

FIG. 9 more clearly illustrates how the proposed rail support arrangement allows a rail to be positioned at a variety of angles, and how this allows the same slab to be used for straight and curved rails. In particular, FIG. 9 illustrates a number of fastening systems securing the rail 990*a* to the rail support arrangement 100*c* at different locations and different angles.

FIG. 9 also illustrates how a second rail support arrangement may be positioned relative to the first in order to accommodate a curved rail. The second rail support arrangement 100*d* is angled relative to the first support arrangement 100*c*, and has a rectangular cut-out in one corner in order to reduce the size of the gap between the slabs at the outer curved rail 990*a*.

Thus, FIG. 9 also illustrates an alternative shape for the rail support arrangement (e.g., rather than being simply cuboidal).

Figure 10:
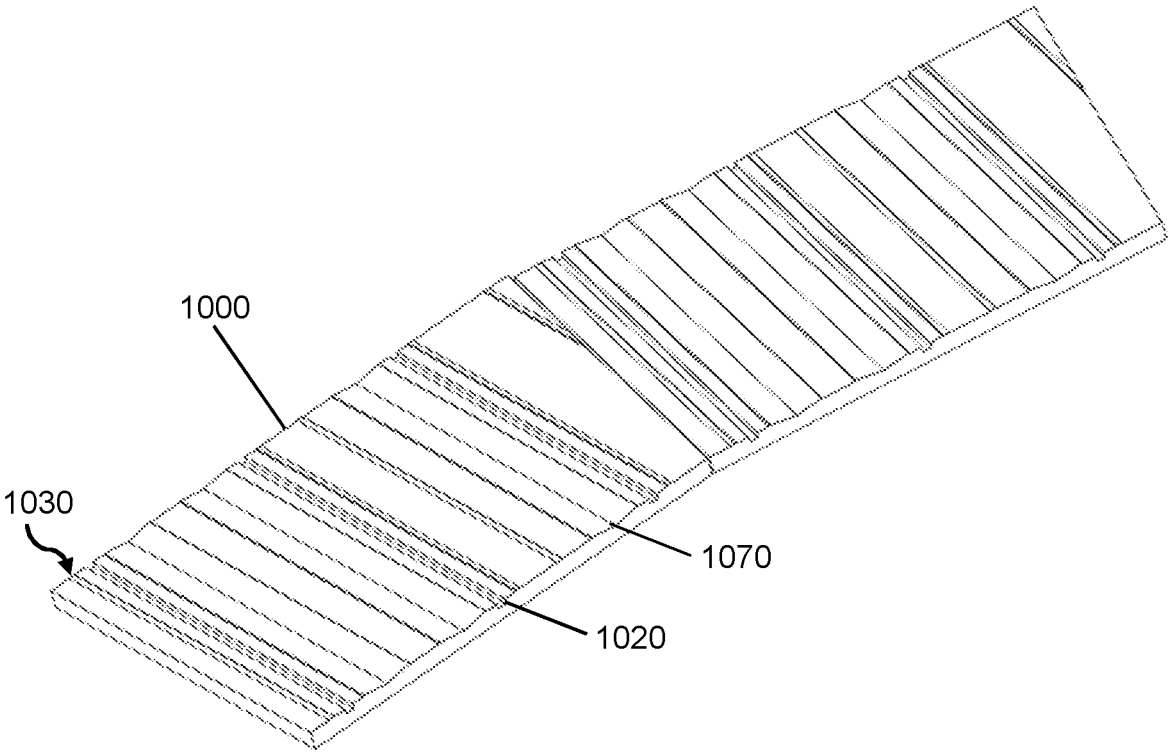
FIG. 10 illustrates an alternative shape of a rail support arrangement.

FIG. 10 illustrates a rail support arrangement 1000, according to another embodiment of the invention. The rail support arrangement 1000 is similar to the rail support arrangement 100 described above, but with fewer primary transverse grooves 1020, differently-shaped secondary transverse grooves 1070, and an asymmetric layout in which the primary transverse grooves are not evenly distributed across the entire length of the slab.

Fewer primary transverse grooves 1020, and therefore fewer rail supports, reduces the cost of manufacturing the rail support arrangement. The illustrated secondary transverse groove(s) 1070 is/are V-shaped, i.e. formed of two angled side walls that meet at a vertex. This shape for the secondary transverse groove(s) helps to reduce peak stress-load levels, and could be employed in any rail support arrangement described in this document or elsewhere.

The asymmetric layout of the rail support arrangement allows the slab to be more easily cut in order to accommodate curves. In FIG. 10, the slabs have been cut diagonally at one end so that adjacent slabs can be angled relative to each other without leaving a large gap between the slabs. Since there is a larger distance from one end of the slab to its nearest primary transverse groove than from the other end of the slab to its nearest primary transverse groove, cutting the slab at the end with the larger distance allows more of the slab to be cut without cutting a rail support compared to a slab with the same number of grooves evenly distributed along the length of the slab.

Figure 11:
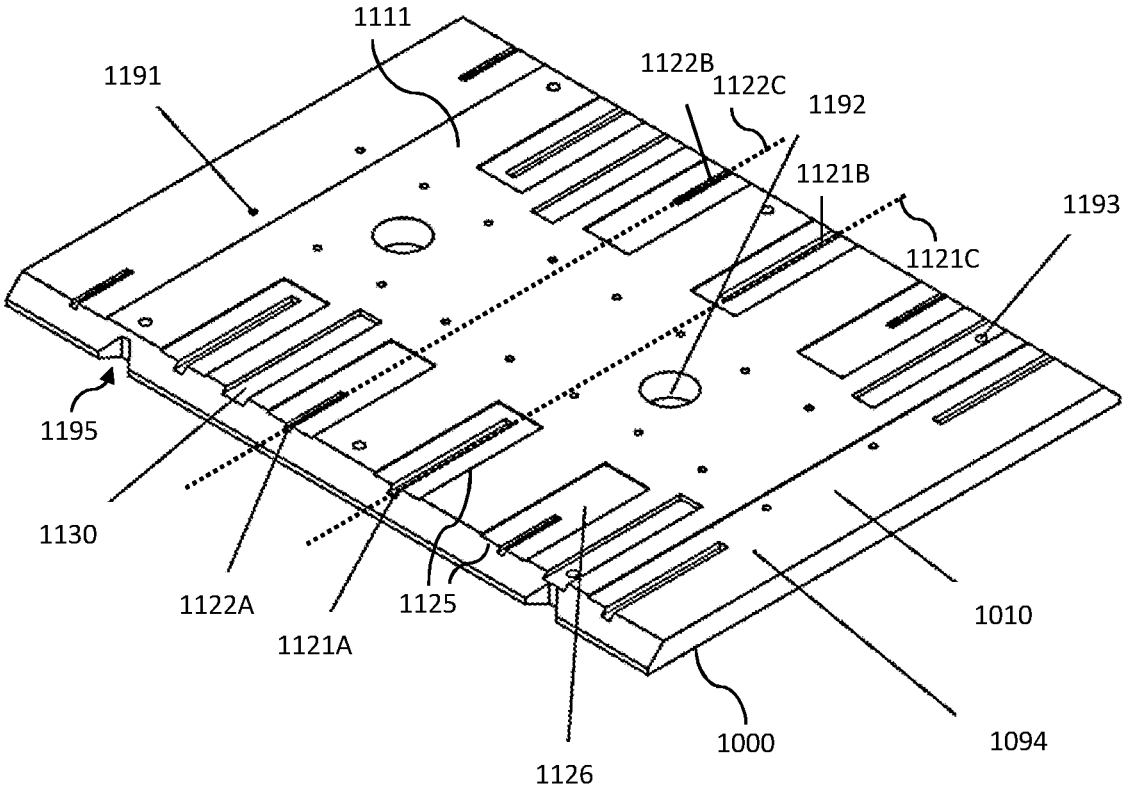
FIG. 11 illustrates another example of a rail support arrangement.

FIG. 11 also illustrates an additional optional feature for a rail support arrangement, namely a fastening aid 1130. The fastening aid provides a visual indicator of a position at which to place elements of a fastening system for connecting a rail (or other piece of railway infrastructure) to the rail support and/or for placement of the elastomeric pad (if present).

The fastening aid 1130 may, for instance, comprise a bump or raised area against which the elastomeric pad is positioned (e.g. braced against or aligned with).

FIG. 11 illustrates another rail support arrangement 1100 according to an embodiment of the invention. In this embodiment, primary transverse grooves are formed in sets of primary transverse grooves, each set being positioned along a respective (hypothetical) axis.

The rail support arrangement 1100 comprises a slab 1110. The slab may be embodied as any previously herein described slab.

The slab 1110 comprises a plurality of primary transverse grooves 1121A, 1121B, 1122A, 1122B. The primary transverse grooves are arranged into sets of primary transverse grooves. For instance, the slab may comprise a first set 1121A, 1121B of primary transverse grooves and a second set 1122A, 1122B of primary transverse grooves. Of course, there may be other sets of primary transverse grooves, but these are not labelled for the sake of clarity.

The primary transverse grooves within any given set are positioned along a same (hypothetical) axis or line that spans across a width of the slab. Thus, each set of primary transverse grooves comprises a plurality of primary transverse grooves positioned along a same hypothetical line, wherein the hypothetical line is different for different primary transverse grooves. For instance, a first set 1121A, 1121B of primary transverse grooves may comprise a first primary transverse groove 1121A and a second primary transverse groove 1121B positioned on a same hypothetical line 1121C. Similarly, a second set 1122A, 1122B of primary transverse grooves may comprise a third primary transverse groove 1122A and a fourth primary transverse groove 1122B positioned along another hypothetical line 1122C.

The sets of primary transverse grooves are positioned in parallel to one another, along the longitudinal direction of the slab.

In the illustrated example, each set of primary transverse grooves comprises only two primary transverse grooves. However, the skilled person will appreciate that a set of primary transverse grooves may comprise three or more primary transverse grooves.

In these examples, each primary transverse groove spans no more than 40% of the entire width of the slab. In preferred examples, each primary transverse groove spans no more than 30% of the entire width of the slab. For each set of primary transverse grooves, the combined length of the primary transverse grooves in that set may no more than 90% of the entire width of the slab, e.g. no more than 60% of the entire width of the slab.

At least one of the primary transverse grooves may be inset or positioned within a supporting transverse groove 1125. A supporting traverse groove is a groove or recess that surrounds a primary transverse groove, so that the primary transverse groove is an additional cut, channel or groove within a larger groove (the supporting transverse groove).

At least one of the supporting transverse grooves may comprise a rail pad area 1126. A rail pad area is configured to support a rail pad upon which a rail (e.g. secured to the rail support mounted in the primary transverse groove that is inset within the supporting transverse groove) rests or is otherwise supported. The rail pad may be appropriately sized and/or configured to house the rail paid, i.e. so that the rail pad is inset from an upper surface 1111 of the slab 1110.

The depth of the secondary transverse grooves may be less than the height of the rail pads that are to be supported in the secondary transverse grooves. For example, the secondary transverse grooves may have a depth of around 5 mm, with the rail pads having a depth of around 9 mm.

Of course, the rail support arrangement may further comprise, for at least one rail pad area, a rail pad configured to support a rail thereon. Each rail pad may be positioned on (top of) a rail pad area. The height of the rail pad may be greater than the depth of the rail pad area on which it is positioned.

The rail pad(s) help(s) to cushion the rail's impact on the slab. In particular, the rail paid helps to spread the load transfer from the rail to the slab, and reduce point stress concentrations. It also provides a vibration absorbing layer.

In some examples, at least two sets of primary transverse grooves are of different lengths. In the illustrated examples, the length of the primary transverse grooves in each set alternates in the longitudinal direction of the slab. Thus, alternate sets of primary transverse grooves (along the longitudinal direction of the slab) comprise primary transverse grooves of alternate lengths.

The longer primary transverse grooves may be used to fix/clamp a rail to the slab. This clamping is particularly secure when two fastening clips are positioned either side of the rail. Hence the primary transverse groove should be sufficiently long enough to accommodate this. The longer primary transverse groove therefore preferably extends either side of a rail, when the rail is secured to the slab.

The shorter primary transverse grooves may be used to secure a steel strip to the outside of the rail jacket (i.e. not directly secure the rail to the slab). This is intended to ensure longevity of the overall structure. In these (and other) circumstances, the shorter primary transverse grooves only require only one fixing bolt at each location, hence it can be shorter.

Preferably, all primary transverse grooves within a same set of primary transverse grooves are of the same length, depth and/or width.

A respective rail support is positioned in each primary transverse groove of the slab. In the illustrated example, the rail support spans at least the entire width of the primary transverse groove. In some examples, the rail support may extend outwardly from the side of the slab 1110. Examples of suitable rail supports have been previously described, and may be used in the present embodiment.

The slab 1110 of the rail support arrangement 1100 may further comprise one or more secondary transverse grooves 1130, in which no rail supports are mounted. The secondary transverse provide improved ease of access for installation, welding, maintenance or repair of rails mounted on the rail support arrangement. Like the primary transverse grooves, the secondary transverse grooves may be formed in sets of secondary transverse grooves, where each secondary transverse groove in a same set are positioned to lie along a same hypothetical (transverse) axis or line.

The slab may comprise one or more through-holes as set out below. Different through holes may be designed for different purposes. Preferably, the through-holes are not positioned in any of the primary transverse grooves or supporting transverse grooves (if present), but they may be positioned in the secondary transverse grooves (if present).

In some embodiments, the slab 1110 comprises a first set of one or more water drainage or water weeping holes 1191. The first set of water drainage/weeping holes may be configured to drain or allow passage of water on an upper surface 1111 of the slab 1110 through the she slab, e.g. through a water channel or pathway. The first set of water drainage/weeping holes may, for instance, have a diameter or width of between 20 mm and 50 mm, e.g. 25 mm.

The first set of water draining/weeping holes 1191 may also be used as an aid during installation of the rail support arrangement 1100. For instance, the first set of water draining/weeping holes may be used to secure temporary anchors (e.g. to more securely anchor the arrangement 1100 to ground) whilst securing one or more rails to the rail support arrangement.

In some embodiments, the slab 1110 comprises one or more bedding layer pouring holes 1192. A bedding layer pouring hole is configured to allow bedding material to be poured through the hole to an underside of the slab 1110. As an example, the bedding layer pouring hole may have a diameter or width of between 150 mm and 400 mm, e.g. around 250 mm.

In some embodiments, the slab 1110 comprises one or more (threaded) through-holes 1193 configured to allow the rail support system to be lifted and/or moved. This allows for ease of installing, removing and/or replacing the rail support system. The through-holes 1193 may be threaded to allow a geometrically corresponding rod or screw to connected to the threaded hole for increased ease and security in lifting/moving the slab. The (threaded) through-holes may be positioned towards a side edge of the upper surface of the slab, no further than 20 cm away from a side edge of the upper surface of the slab.

The through-holes 1193 can be used, for instance, to position the slab at a desired position/location prior to casting a bedding layer beneath the slab, using an appropriately connected lifting mechanism such as a crane. Alternatively, the through-holes could be used to maneuver the slab to a desired location and embed the slab in a partially set bedding layer.

In some examples, the slab 1110 comprises a second set of one or more weeping holes 1194. The weeping holes are configured to allow for water drainage or exiting from the (upper surface of the) slab, but may have a smaller diameter/width than the first set of water drainage holes (if present).

The slab may comprise one or more notches 1195 in a side edge of the slab. These notches may be aligned (e.g. along a transverse axis) with one or more of the (threaded) through-holes. The notches facilitate the installation of a load spreading plate beneath the threaded rod to aid in installation of the slab.

The rail support arrangement 1100 may be modified according to any feature of any previously described rail arrangement, e.g. to make use of any of the configurations for a rail support illustrated in FIG. 4 or to include the optional fastening aid illustrated in FIG. 11. Similarly, any previously described rail support arrangement may be modified to include any feature of the rail support arrangement described with reference to FIG. 11 (e.g. to include water weeping holes or any described other through-hole, or to be formed of primary transverse grooves divided into sets of primary transverse grooves)

In the examples described above, the rail supports are used to couple rails and stiffening bars to the rail support arrangement. However, the rail supports may be used to tie any other suitable track element to the rail support arrangement. Track elements that may be coupled to a rail support of the rail support arrangement include baseplates, clips, insulators, clip blockers, third rail brackets, derailment containment devices, and so on. Reference to "rail" may be replaced by reference to a "track element" where suitable.

Variations to the disclosed embodiments can be understood and effected by those skilled in the art in practicing the claimed invention, from a study of the drawings, the disclosure and the appended claims. In the claims, the word "comprising" does not exclude other elements or steps, and the indefinite article "a" or "an" does not exclude a plurality.

The mere fact that certain measures are recited in mutually different dependent claims does not indicate that a combination of these measures cannot be used to advantage. If the term "adapted to" is used in the claims or description, it is noted the term "adapted to" is intended to be equivalent to the term "configured to". Any reference signs in the claims should not be construed as limiting the scope.

The invention claimed is:

1. A rail support arrangement for supporting one or more rails, the rail support arrangement comprising:

a slab, formed from fiber reinforced concrete, having two or more primary transverse grooves, wherein a height of the slab is no greater than 15 cm; and a plurality of rail supports, each rail support being mounted in a respective primary transverse groove and comprising at least one projection configured to engage with a rail fastening system, received in the respective primary transverse groove, that couples a rail to the rail support so as to restrict or prevent a movement of the rail in a direction (x) perpendicular to the direction (y) of the respective primary transverse groove.

2. The rail support arrangement of claim 1, wherein each primary transverse groove spans no more than 40% of the entire width of the slab.

3. The rail support arrangement of claim 1, wherein the two or more primary transverse grooves comprises two or more sets of primary transverse grooves, wherein each primary transverse groove in a same set are positioned along a same hypothetical transverse line.

4. The rail support arrangement of claim 3, wherein, for each set of primary transverse grooves, the combined length of the primary transverse grooves in that set is no more than 60% of the entire width of the slab.

5. The rail support arrangement of claim 1, wherein each primary transverse groove spans no less than 10% of the entire width of the slab.

6. The rail support arrangement of claim 1, wherein the two or more primary transverse grooves comprises at least two primary transverse grooves of different lengths.

7. The rail support arrangement of claim 1, wherein the slab further comprises, for each of one or more primary transverse grooves, a supporting transverse groove into which the primary transverse groove is inset.

8. The rail support arrangement of claim 7, wherein at least one supporting transverse groove comprises a rail pad area configured to support a rail pad upon which a rail is supportable.

9. The rail support arrangement of claim 8, further comprising, for at least one rail pad area, a rail pad configured to support a rail thereon.

10. The rail support arrangement of claim 1, wherein the rail support comprises a first projection and a second projection, each configured to simultaneously engage with the rail fastening system to thereby couple the rail to the rail support.

11. The rail support arrangement of claim 1, wherein the slab is formed from ultra-high performance fiber reinforced concrete.

12. The rail support arrangement of claim 1, wherein the slab has a length no greater than 12 m.

13. The rail support arrangement of claim 1, wherein each rail support comprises a plurality of elongate anchors, each configured to protrude into the slab, to thereby secure the rail support to the slab.

14. The rail support arrangement of claim 1, wherein the height of the slab is no greater than 11 cm.

15. The rail support arrangement of claim 1, wherein the slab further comprises one or more secondary transverse grooves in which no rail supports are mounted.

16. The rail support arrangement of claim 15, wherein the width of each secondary transverse groove is greater than the width of each primary transverse groove.

17. The rail support arrangement of claim 15, wherein the distance between each secondary transverse groove is no less than 0.75 m.

18. A rail support system comprising:

a first rail support arrangement;

a second rail support arrangement; and a stiffening bar adapted to couple a rail support of the first rail support arrangement to a rail support of the second rail support arrangement, wherein each of the first rail support arrangement and the second rail support arrangement comprises:

a slab, formed from fiber reinforced concrete, having two or more primary transverse grooves, wherein a height of the slab is no greater than 15 cm; and a plurality of rail supports, each rail support being mounted in a respective primary transverse groove and comprising at least one projection configured to engage with a rail fastening system, received in the respective primary transverse groove, that couples a rail to the rail support so as to restrict or prevent a movement of the rail in a direction (x) perpendicular to the direction (y) of the respective primary transverse groove.

19. The rail support system of claim 18, wherein the stiffening bar is configured to distribute a shear stress between the first and second rail support arrangements.

20. A rail securing system comprising a rail support system comprising:

a rail support arrangement comprising:

a slab, formed from fiber reinforced concrete, having two or more primary transverse grooves, wherein a height of the slab is no greater than 15 cm; and a plurality of rail supports, each rail support being mounted in a respective primary transverse groove and comprising at least one projection configured to engage with a rail fastening system, received in the respective primary transverse groove, that couples a rail to the rail support so as to restrict or prevent a movement of the rail in a direction (x) perpendicular to the direction (y) of the respective primary transverse groove;

a stiffening bar adapted to couple a rail support of the rail support arrangement to a rail support of another rail support arrangement; and one or more rail fastening systems, each rail fastening system being configured to:

engage with an upper surface of a rail support of the rail support arrangement, and couple a rail to the rail support, so as to restrict or prevent movement of the rail in a direction perpendicular to the direction of the respective primary transverse groove.

21. A rail system comprising a rail support system comprising:

a rail support arrangement comprising:

a slab, formed from fiber reinforced concrete, having two or more primary transverse grooves, wherein a height of the slab is no greater than 15 cm; and a plurality of rail supports, each rail support being mounted in a respective primary transverse groove and comprising at least one projection configured to engage with a rail fastening system, received in the respective primary transverse groove, that couples a rail to the rail support so as to restrict or prevent a movement of the rail in a direction (x) perpendicular to the direction (y) of the respective primary transverse groove;

a stiffening bar adapted to couple a rail support of the rail support arrangement to a rail support of another rail support arrangement;

one or more rail fastening systems, each rail fastening system being configured to:

engage with an upper surface of the rail support of a rail support arrangement; and couple a rail to the rail support, so as to restrict or prevent movement of the rail in a direction perpendicular to the direction of the respective primary transverse groove; and one or more rails, each rail being coupled by the one or more rail fastening systems to one or more rail supports.

* * * * *